US008674299B2

(12) United States Patent
Hirabayashi et al.

(10) Patent No.: US 8,674,299 B2
(45) Date of Patent: Mar. 18, 2014

(54) MASS SPECTROMETRIC SYSTEM

(75) Inventors: Atsumu Hirabayashi, Kodaira (JP); Hiroyuki Satake, Tokorozawa (JP)

(73) Assignee: Hitachi High-Technologies Corporation, Tokyo (JP)

( * ) Notice: Subject to any disclaimer, the term of this patent is extended or adjusted under 35 U.S.C. 154(b) by 65 days.

(21) Appl. No.: 13/148,732

(22) PCT Filed: Feb. 15, 2010

(86) PCT No.: PCT/JP2010/052170

§ 371 (c)(1), (2), (4) Date: Aug. 10, 2011

(87) PCT Pub. No.: WO2010/095586

PCT Pub. Date: Aug. 26, 2010

(65) Prior Publication Data

US 2011/0315868 A1 Dec. 29, 2011

(30) Foreign Application Priority Data

Feb. 19, 2009 (JP) ..... 2009-036629

(51) Int. Cl.
*H01J 49/42* (2006.01)
*H01J 49/14* (2006.01)

(52) U.S. Cl.
USPC ..... 250/290; 250/281; 250/282; 250/283; 250/287; 250/291

(58) Field of Classification Search
USPC ..... 250/281, 282, 283, 287, 290, 291
See application file for complete search history.

(56) References Cited

U.S. PATENT DOCUMENTS

| | | | | |
|---|---|---|---|---|
| 5,572,022 | A | 11/1996 | Schwartz et al. | |
| 6,177,668 | B1 | 1/2001 | Hager | |
| 6,720,554 | B2 * | 4/2004 | Hager | 250/282 |
| 6,924,478 | B1 * | 8/2005 | Zubarev et al. | 250/282 |
| 6,987,261 | B2 * | 1/2006 | Horning et al. | 250/282 |
| 7,060,972 | B2 * | 6/2006 | Hager | 250/282 |
| 7,064,319 | B2 * | 6/2006 | Hashimoto et al. | 250/287 |
| 7,145,133 | B2 * | 12/2006 | Thomson | 250/281 |
| 7,157,698 | B2 * | 1/2007 | Makarov et al. | 250/281 |
| 7,342,224 | B2 * | 3/2008 | Makarov et al. | 250/290 |
| 7,507,953 | B2 * | 3/2009 | Makarov et al. | 250/287 |
| 7,534,622 | B2 * | 5/2009 | Hunt et al. | 436/173 |
| 7,566,870 | B2 * | 7/2009 | Hasegawa et al. | 250/292 |

(Continued)

FOREIGN PATENT DOCUMENTS

| | | |
|---|---|---|
| JP | 2005-353304 | 12/2005 |
| JP | 2006-234782 | 9/2006 |
| JP | 2008-130469 | 6/2008 |
| JP | 2009-026465 | 2/2009 |

*Primary Examiner* — David A Vanore

(74) *Attorney, Agent, or Firm* — Antonelli, Terry, Stout & Kraus, LLP.

(57) ABSTRACT

A mass spectrometric device of the present invention includes a quadrupole filter (12) located upstream of a quadrupole ion trap (13) and configured to transmit ions in a predetermined filter range, and determines the filter range of the quadrupole filter (12) such that accumulation time for the ions in the quadrupole ion trap (13) is maximized. The accumulation time for the ions is determined based on mass spectrometry data information. With this configuration, the present invention produces advantageous effects of improving analysis throughput and an S/N ratio in an analysis of a minor sample component mixed in various accompanying components by using the mass spectrometric device using the quadrupole ion trap.

4 Claims, 19 Drawing Sheets

(56) References Cited

U.S. PATENT DOCUMENTS

| | | | | |
|---|---|---|---|---|
| 7,569,814 | B2 * | 8/2009 | Hashimoto et al. | 250/282 |
| 7,692,142 | B2 * | 4/2010 | Schwartz et al. | 250/290 |
| 7,800,058 | B2 | 9/2010 | Sugiyama et al. | |
| 7,829,842 | B2 * | 11/2010 | Makarov | 250/283 |
| 7,858,929 | B2 * | 12/2010 | Makarov et al. | 250/282 |
| 7,880,136 | B2 * | 2/2011 | Makarov et al. | 250/282 |
| 8,198,580 | B2 * | 6/2012 | Schwartz et al. | 250/281 |
| 2003/0022211 | A1 | 1/2003 | Blatcher et al. | |
| 2003/0071206 | A1 | 4/2003 | Belov et al. | |
| 2005/0127290 | A1 * | 6/2005 | Hashimoto et al. | 250/288 |
| 2005/0269504 | A1 | 12/2005 | Hashimoto et al. | |
| 2006/0169892 | A1 | 8/2006 | Baba et al. | |
| 2008/0078930 | A1 | 4/2008 | Baba et al. | |
| 2008/0156979 | A1 | 7/2008 | Hashimoto et al. | |
| 2009/0020695 | A1 * | 1/2009 | Satake et al. | 250/287 |
| 2011/0204221 | A1 * | 8/2011 | Satake et al. | 250/282 |
| 2011/0315868 | A1 * | 12/2011 | Hirabayashi et al. | 250/282 |
| 2012/0032079 | A1 * | 2/2012 | Nakasuji et al. | 250/310 |
| 2012/0261568 | A1 * | 10/2012 | Coon et al. | 250/282 |
| 2012/0292495 | A1 * | 11/2012 | Hashimoto et al. | 250/281 |
| 2012/0305762 | A1 * | 12/2012 | Kaneko et al. | 250/283 |

* cited by examiner

MASS SPECTROMETRIC SYSTEM

TECHNICAL FIELD

The present invention relates to a mass spectrometer capable of analyzing minor components and more specifically to a mass spectrometer and a liquid chromatographic-mass spectrometric system capable of performing tandem mass spectrometry on numerous components in a sample at high throughput.

BACKGROUND ART

In a proteomic analysis for comprehensively analyzing proteins extracted from a living organism or in a high-throughput analysis of low-molecular compounds existing in a biological fluid such as blood, a liquid chromatographic-mass spectrometer (LC/MS) which can separately analyze sample components are often used because the number of the target components is large. In the mass spectrometer, an effluent separated by a liquid chromatograph or the like is introduced to an ion source so as to generate gaseous ions originating from the sample components, and the generated ions are introduced into a vacuum device and are subjected to mass spectrometry (MS) and tandem mass spectrometry (MS/MS). Thereafter, the sample components are identified by analyzing tandem mass spectrometry data and the quantities of the sample components are determined by use of a mass spectrometry result or a tandem mass spectrometry result. The biological sample used in such an analysis is characterized in that the sample contains very many types of components to be analyzed and that the components vary in concentration by many orders of magnitude. In general, precursor ions for the tandem mass spectrometry are selected by using a data dependent analysis in which the components are prioritized and analyzed in descending order of ion intensity. However, a time duration in which the ions are generated for the tandem mass spectrometry is limited by a band width of the liquid chromatograph (LC). Since the analysis throughput of the mass spectrometer is limited, it may be difficult to analyze all the detected ions in the tandem mass spectrometry. In the current circumstances, the tandem spectrometry data of a component having high ion intensity (a high concentration) can be relatively easily obtained because the component has a high priority in the data dependent analysis. On the other hand, a minor component having low priority may be excluded from targets for the tandem mass spectrometry even when the ions of the component are detected in the mass spectrometry spectrum. Moreover, even if the component is subjected to the tandem mass spectrometry, data with an S/N ratio high enough to be amenable to analysis cannot be obtained in some cases.

Exemplar spectrometers employed as the mass spectrometer required to achieve high analysis throughput in the tandem mass spectrometry as described above include a quadrupole-TOF (Time of Flight) mass spectrometer, a quadrupole ion-trap mass spectrometer, a quadrupole ion-trap TOF mass spectrometer, and a quadrupole ion-trap FT (Fourier Transform) mass spectrometer. Among these, the mass spectrometer using a quadrupole ion trap requires consideration of a space charge effect.

The quadrupole ion trap can perform mass spectrometry on (numerous types of) ions introduced from the ion source by trapping the ions while holding the ions spatially for certain time (accumulation time). In addition, the quadrupole ion trap can isolate (isolation) only the precursor ions and generate multiple types of production ions (fragment ions) by use of a dissociation method such as collision-induced dissociation (CID), infrared multiphoton dissociation (IRMPD), electron capture dissociation (ECD) or electron transfer dissociation (ETD). The tandem mass spectrometry data are obtained by performing mass spectrometry on these fragment ions.

PRIOR ART DOCUMENTS

Non-Patent Documents

Patent Document 1: U.S. Pat. No. 6,978,261 B1
Patent Document 2: U.S. Pat. No. 6,177,668 B1
Patent Document 3: US 2003/071206 A1
Patent Document 4: U.S. Pat. No. 5,572,022 B1
Patent Document 5: US 2003/022211 A1
Patent Document 6: US 2005-0127290 A1
Patent Document 7: JP 2005-353304 A
Patent Document 8: JP 2008-130469
Patent Document 9: JP 2006-234782 A

SUMMARY OF THE INVENTION

Problem to be Solved by the Invention

When the ions are continuously generated, a large amount of ions are introduced into the quadrupole ion trap if the accumulation time is long. When a certain amount or more of the ions are introduced into the quadrupole ion trap, the space charge effect occurs and reduces ion trapping efficiency. FIG. 2 shows an accumulation time dependence of a total ion current. When the accumulation time is set at 20 milliseconds or below, the total ion current is proportional to the accumulation time. However, the total ion current is hardly increased when the accumulation time is 20 milliseconds or above. This is because the introduced ion current exceeds an ion current that can be trapped by the quadrupole ion trap due to the space charge effect and the ion trapping efficiency is thereby reduced. As a different example, FIG. 3 shows an accumulation time dependence of a peak area of specific ions. In this example, the ions dissociate due to the space charge effect when the accumulation time exceeds 10 milliseconds, and thus the ion intensity is reduced. The occurrence of the space charge effect as described above poses problems in analytical sensitivity and quantitative reliability of the data.

In order to avoid the occurrence of the space charge effect, it is effective to set an upper limit of the ion current introduced to the quadrupole ion trap and to control the accumulation time. Moreover, it is practical to evaluate the ion current by using a total ion current or a sum of peak areas in a mass spectrum. However, when minor ions mixed in the high-intensity ions are selected as the precursor ions, only a very small amount of the precursor ion current is trapped by the quadrupole ion trap, so that only the tandem spectrometry data having a low S/N ratio can be obtained. To improve the S/N ratio of the data, it is necessary to increase either a repeated count of analysis or a cumulated count in the data obtaining, which results in reduction in the analysis throughput.

In principle, when a quadrupole filter (a Q filter) is installed between the quadrupole ion trap and the ion source to limit a m/z range of the ions introduced to the quadrupole ion trap, the accumulation time can be extended and a large amount of the precursor ions can be introduced to the quadrupole ion trap. As a result, it is possible to suppress reduction in the analysis throughput in the tandem mass spectrometry of the minor component.

Moreover, the analysis throughput can be enhanced by installing another ion trap (a pre-trap) between the Q filter and the quadrupole ion trap. Specifically, the ions transmitted through the Q filter are trapped by the pre-trap while the quadrupole ion trap is not performing accumulation. Then, the ions accumulated by the pre-trap are moved to the quadrupole ion trap at a time when the quadrupole ion trap can perform accumulation. In this way, it is possible to make effective use of generated ions.

Further, although the CID of the precursor ions can be preformed inside the quadrupole ion trap, this CID can also be carried out in a device such as a collision cell installed downstream of the quadrupole ion trap. In this case, only the precursor ions are emitted from the quadrupole ion trap to the downstream side. The CID is expected to produce effects of, for example, enabling detection of multiple types of fragment ions through multiple times of dissociation reactions.

In addition, if the multiple precursor ions can be emitted sequentially in one ion trap (accumulation), the tandem mass spectrometry can be performed on the multiple precursor ions. This can enhance the analysis throughput.

An object to be achieved by the present invention is to enhance analysis throughput of a mass spectrometer using a quadrupole ion trap in an analysis of a minor sample component mixed in various accompanying components.

Means for Solving the Problem

A mass spectrometer of the present invention is mainly characterized in that a Q filter is installed on an upstream side of a quadrupole ion trap, that a filter region of the Q filter is determined so as to maximize ion trapping time in the quadrupole ion trap, and accumulation time is determined based on mass spectrometry data information.

Another characteristic of the present invention is that a different ion trap (a pre-trap) is installed between the Q filter and the ion trap described above, the filter region of the Q filter is determined so as to maximize ion trapping time in the different ion trap, and accumulation time is determined based on mass spectrometry data information.

Effect of the Invention

A mass spectrometer of the present invention has advantageous effects of enhancing analysis throughput and enhancing an S/N ratio in tandem mass spectrometry of a minor component mixed in major components.

MODES FOR CARRYING OUT THE INVENTION

Embodiments of the present invention will be described below with reference to the accompanying drawings. In the present invention, an object of accumulating more precursor ions in a quadrupole ion trap in tandem mass spectrometry of a minor component is achieved by carrying out system control for avoiding a space charge effect.

First Embodiment

Figure 1:
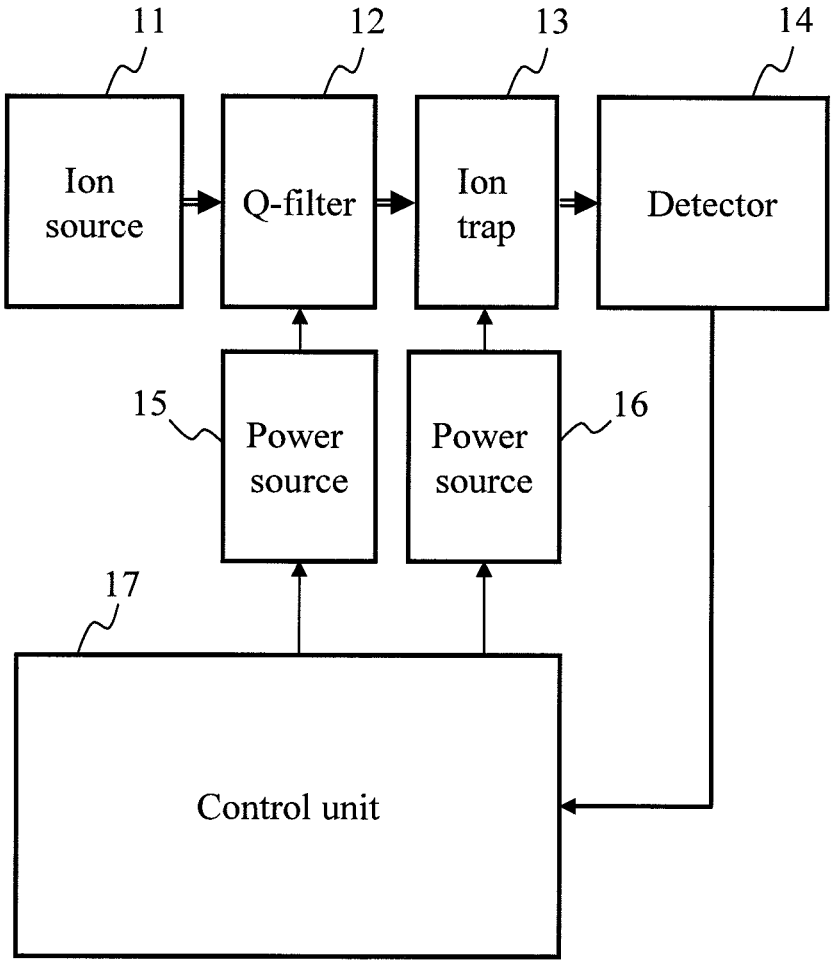
FIG. 1 is a block diagram of an embodiment of a device according to the present invention.
Figure 2:
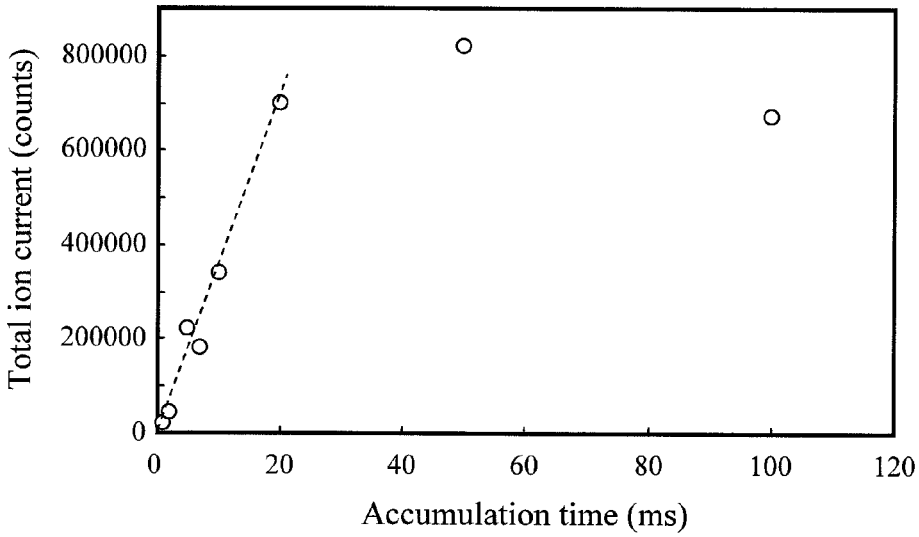
FIG. 2 is a diagram showing an accumulation time dependence of a total ion current.
Figure 3:
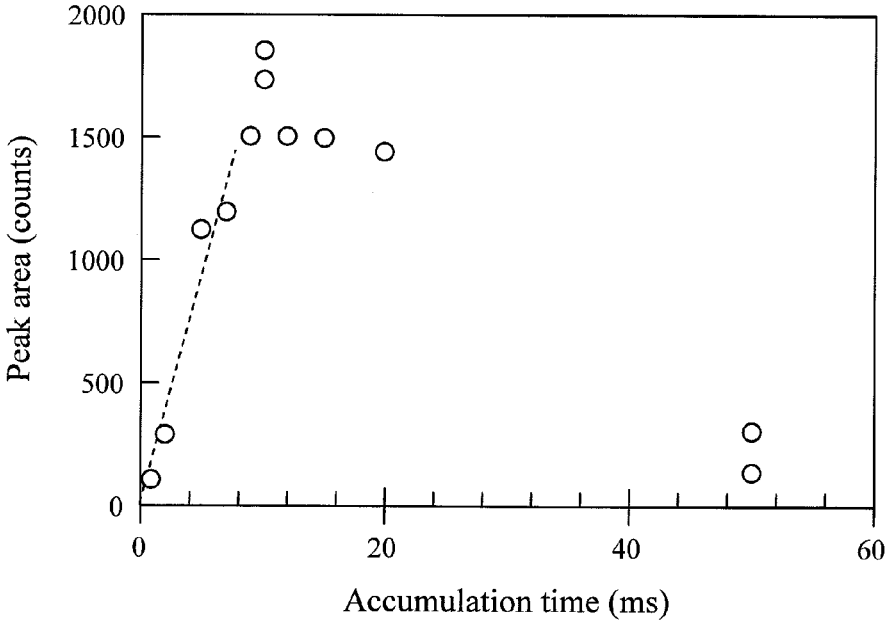
FIG. 3 is a diagram showing an accumulation time dependence of a peak area of a specific ion.
Figure 4:
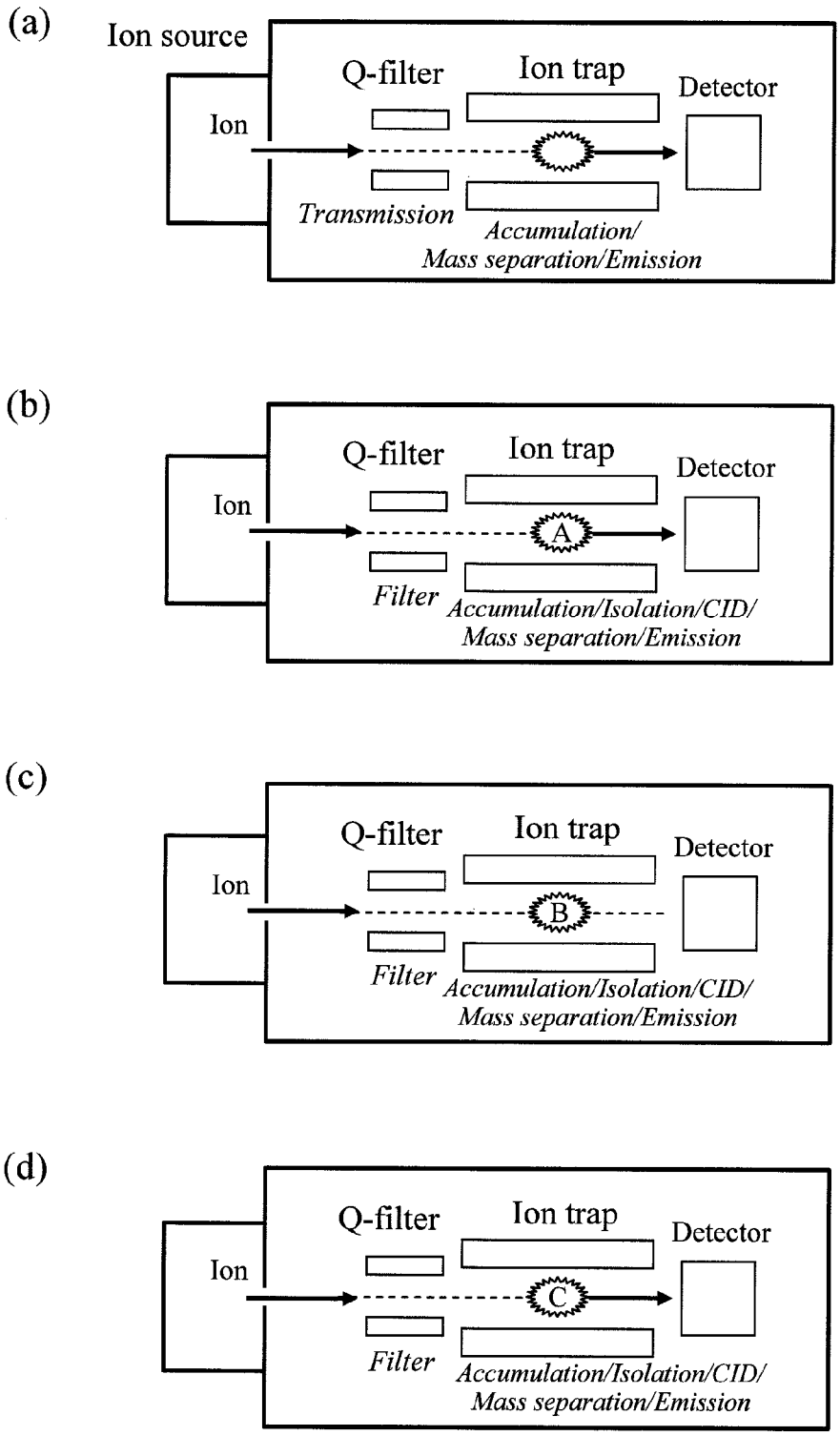
FIG. 4 is a schematic diagram showing movement of ions in the embodiment of the device according to the present invention.

FIG. 1 is a block diagram of an embodiment of a mass spectrometric device according to the present invention. FIG. 4 in which no power sources and control unit are illustrated is a schematic diagram showing movement of ions in the device. Ions generated by an ion source 11 transmit through a Q filter 12 installed inside a vacuum device to be introduced to a quadrupole ion trap 13. The quadrupole ion trap 13 may be a linear ion trap formed of four rod electrodes or may be a three-dimensional quadrupole ion trap formed of a ring electrode and a pair of cap electrodes. The ions emitted from the ion trap 13 are detected with a detector 14. A power source 15 for the Q filter 12 and a power source 16 for the quadrupole ion trap 13 are controlled by a control unit 17.

In obtaining mass spectrometry data shown in FIG. 4(*a*), the Q filter power source 15 is controlled by the control unit 17 so that the majority of the ions can be transmitted through the Q filter 12 almost independently of a m/z (mass to charge ratio). Then, the quadrupole ion trap power source 16 is controlled by the control unit 17 such that these ions accumulate in the quadrupole ion trap 13, and a radio-frequency voltage is applied to the quadrupole ion trap 13. In the quadrupole ion trap 13, a largest possible total ion current for not causing a space charge effect can be found by way of experiment in advance. Thus, the quadrupole ion trap power source 16 is controlled by the control unit 17 so as not to exceed the maximum value or an upper limit whereby ion accumulation is carried out only for a required time period. After the accumulation is completed, the power source 16 operates the quadrupole ion trap 13 so as to emit the ions based on the m/z, and a mass spectrum is obtained by detecting the emitted ions with the detector 14.

Figure 21:
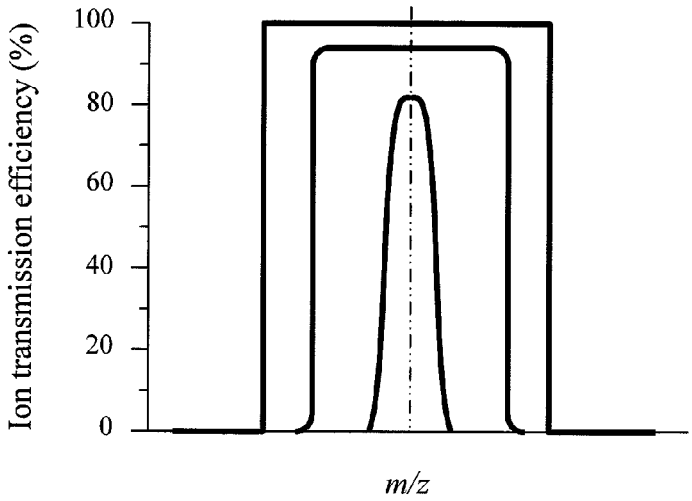
FIG. 21 is a schematic diagram showing relationships between filter ranges and ion transmission curves.

Next, in obtaining tandem mass spectrometry data shown in FIG. 4(*b*) to FIG. 4(*d*), precursor ions subjected to the tandem mass spectrometry are selected by the control unit based on the obtained mass spectrum and also the center of a filter range in the Q filter and accumulation time using the quadrupole ion trap are determined. Here, the Q filter may be of a simple structure but is preferably configured to achieve substantially 100% of ion transmission efficiency. FIG. 21 schematically shows ion transmission efficiency curves corresponding to three types of filter ranges. As it is understood from FIG. 21, substantially 100% of the ion transmission efficiency in an ion transmission rage can be achieved when setting a wide filter range. However, if a narrow filter range is set, the ion transmission efficiency does not become constant in the filter range and maximum ion transmission efficiency tends to fall below 100%. Therefore, in order to achieve substantially 100% of the ion transmission efficiency, it is practical to set the filter range as wide as several tens of Da rather than setting the filter range as narrow as several Da. Moreover, the control unit controls the Q filter power source so that the accumulation time is maximized and sets the center of the filter range in the Q filter. As a result, the m/z of the precursor ion does not always coincide with the center of the filter range but a group of ions (A) including the precursor ion transmits through the Q filter to be accumulated in the quadrupole ion trap. In this way, the Q filter and the quadrupole ion trap are controlled by the control unit and the accumulation is executed in preparation for the tandem mass spectrometry.

After completing the accumulation, isolation for eliminating ions other than the precursor ion in the quadrupole ion trap is carried out by applying a radio-frequency electric field. Moreover, movement of the precursor ion is excited by using another radio-frequency electric field so as to implement dissociation (collision-induced dissociation, CID) of the precursor ion by way of collisions with residue gas. The power source operates so that fragment ions thus generated are emitted to the detector based on the m/z, and a tandem mass spectrometry spectrum is obtained by sequentially detecting the emitted ions with the detector. These processes are sequentially performed on ion groups A, B, C, and so on.

A method of determining the filter range in the Q filter will be described by using mass spectra shown in FIGS. 5(*a*) and 5(*b*). The selected precursor ion is indicated with ○ in the drawings while the filter ranges in the Q filter are indicated with dotted lines and arrows. As shown in the drawings, when a large number of ions are detected, multiple ions are often included in the filter range in the Q filter. Accordingly, a width of the filter range is preferably set to the narrowest possible value for providing substantially equal to 100% of the ion transmission efficiency.

Figure 5:
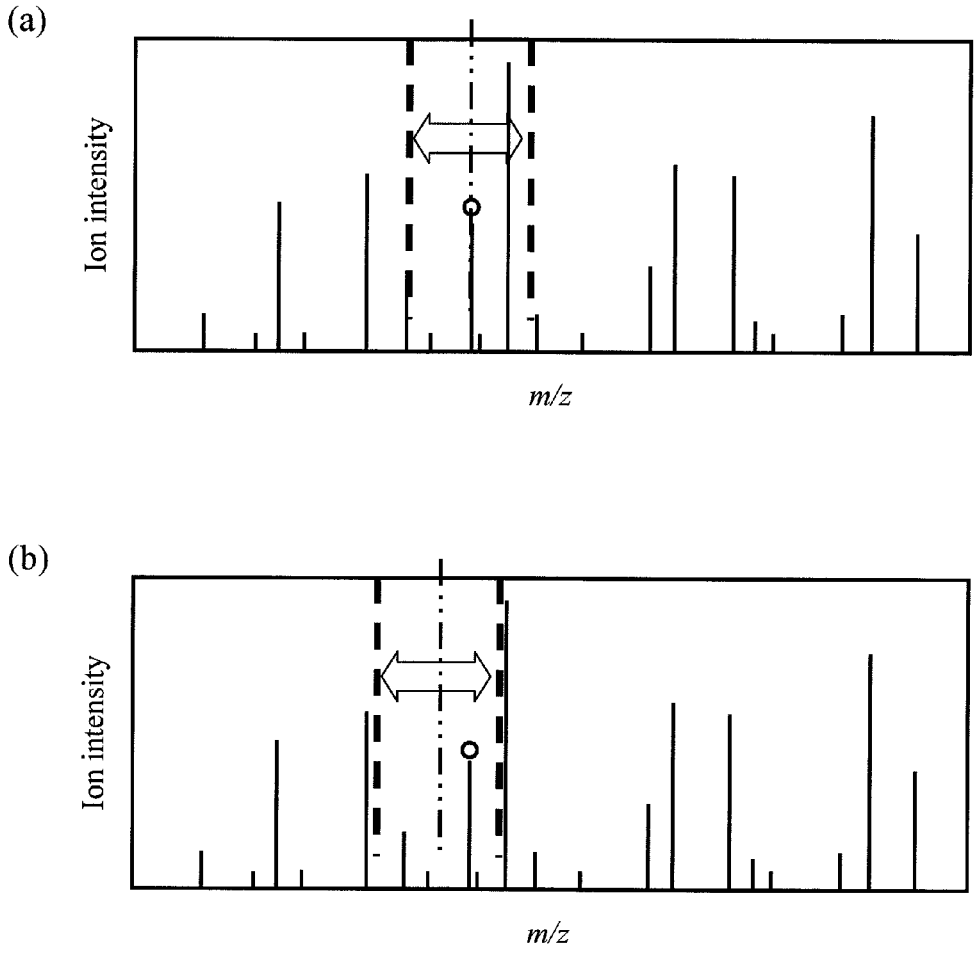
FIG. 5 is a diagram showing filter ranges of a Q filter in mass spectra.

FIG. 5(*a*) shows an example where the center (a chain double-dotted line) of the filter range in the Q filter substantially coincides with a precursor ion. Specifically, the center of the filter range in the Q filter is set to be located closest to the center of the precursor ion in device setting. On the other hand, in FIG. 5(*b*), the width of the filter range in the Q filter is the same but the center is optimized. Specifically, a total ion current or a sum of peak areas in the filter range is reduced to approximately ⅓ of the case of FIG. 5(*a*). As a result, the accumulation time can be increased by about three times, and the number of precursor ions that can be trapped by one accumulation can be eventually increased by about three times. This means a significant increase in an S/N ratio in the tandem mass spectrometry data. Moreover, as compared to the data cumulated through multiple times of repeated analysis in FIG. 5(*a*), the tandem mass spectrometry data of a similar S/N ratio can be obtained with a cumulated count reduced to ⅓. This means enhancement in analysis throughput.

It is convenient if a user can select whether the center of the filter range in the Q filter coincides substantially with the precursor ion as shown in FIG. 5(*a*) or the center is optimized as shown in FIG. 5(*b*) on a screen of a control PC of the device or the like. When the filter range in the Q filter is set to a relatively narrow width such as equal to or below 10 Da, the ion transmission efficiency may fall substantially below 100% at boundary regions of the filter range (see FIG. 21). In this case, it is safe to select the mode in which the center of the filter range coincides substantially with the precursor ion as shown in FIG. 5(*a*). For this reason, it is convenient if a mode is automatically selected when changing the width of the filter range in the Q filter. Specifically, when the user designates a filter range which is narrower than the filter range for achieving substantially 100% of the ion transmission efficiency, a mode in which the center of the filter range coincides with the precursor ions is automatically selected. Meanwhile, the device is set to automatically select a mode for optimizing the filter range relative to the precursor ions in other cases, i.e., a mode for determining the filter range including the m/z of the precursor ion and minimizing the total ion current or the sum of the peak areas.

Figure 6:
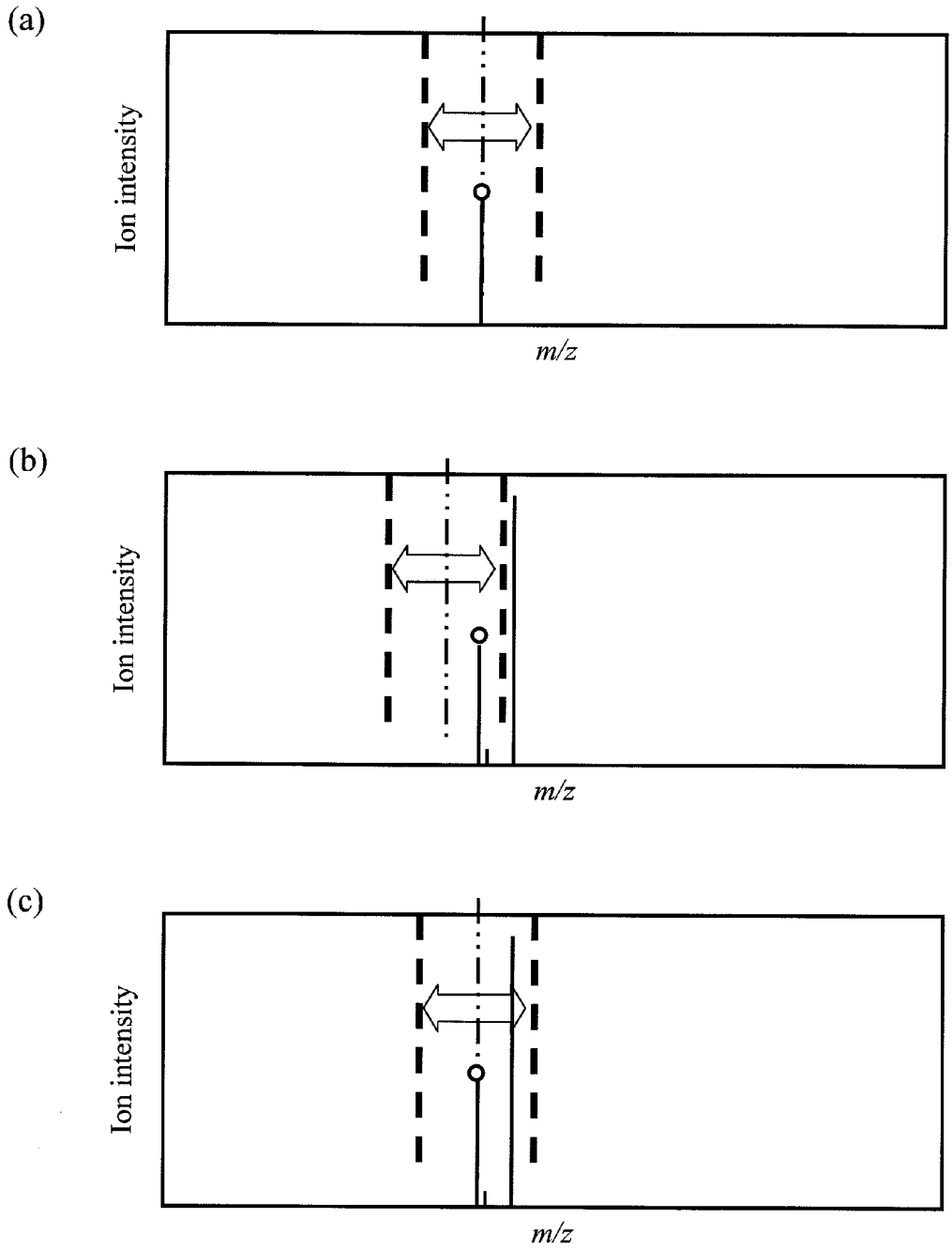
FIG. 6 is a diagram showing filter ranges of a Q filter in mass spectra.

It is possible to check whether the center of the filter range in the Q filter coincides substantially with the precursor ion or is optimized by obtaining data as described below. Specifically, as shown in FIG. 6(*a*), the tandem mass spectrometry is firstly performed on a precursor ion located in the filter range in which no other ions are detected. Next, ion generation is performed by adjusting a sample so as to detect other ions having high intensity within the Q filter range while substantially maintaining the same intensity of the precursor ions. Then, the tandem mass spectrometry is performed on the aforementioned precursor ion. If the center of the filter range in the Q filter is optimized as shown in FIG. 6(*b*), the accumulation time or the cumulated count of the data is supposed to coincide substantially with precedent data. On the other hand, if the center of the filter range in the Q filter coincides substantially with the precursor ion as shown in FIG. 6(*c*), the accumulation time is supposed to be reduced. That is, when the center of the filter range in the Q filter is optimized, the accumulation time for the same precursor ions becomes equivalent or longer as compared to an unoptimized case.

Figure 7:
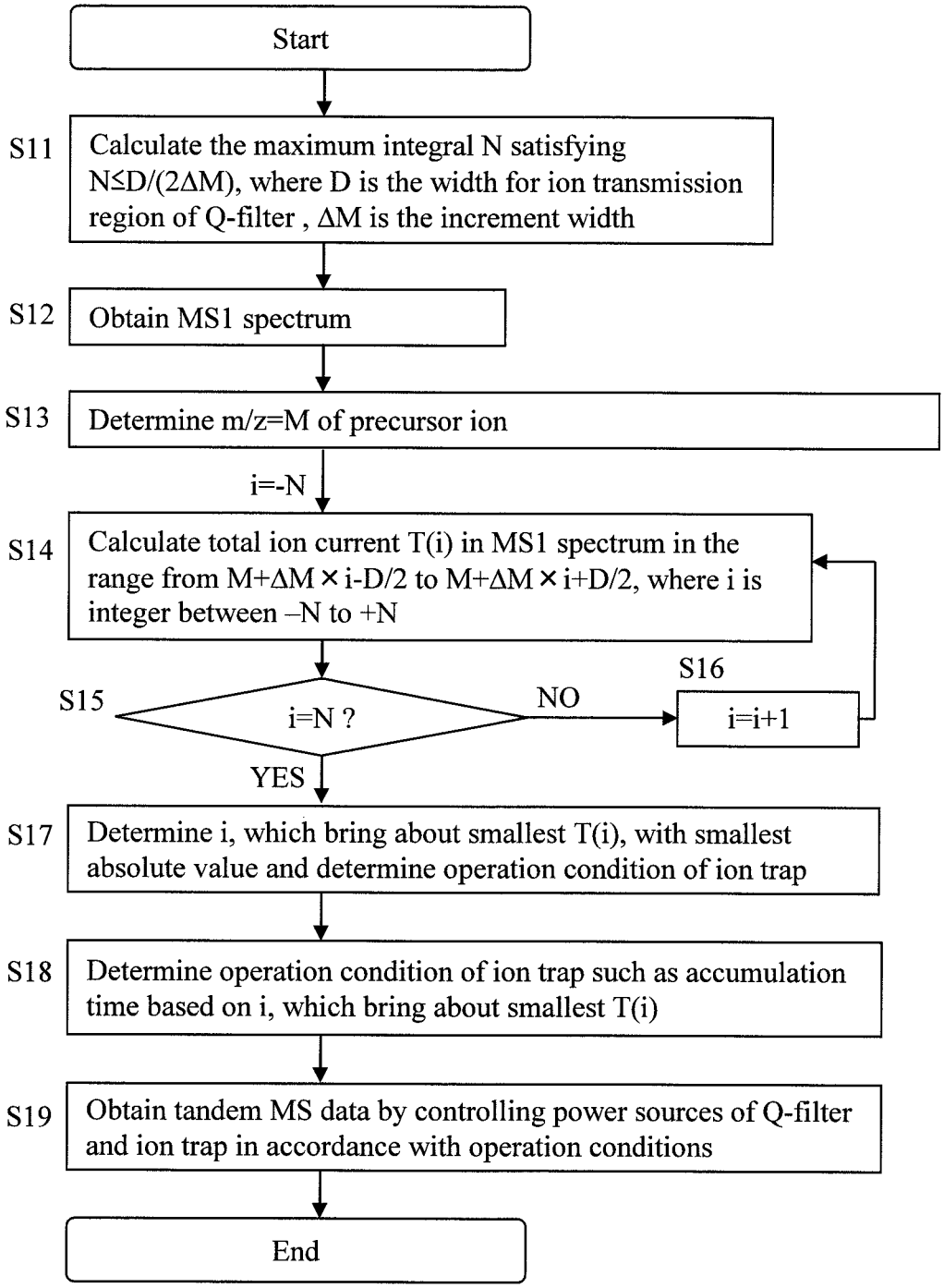
FIG. 7 is a flowchart showing an example of a method of determining the filter range of the Q filter.

FIG. 7 is a flowchart showing an example of a method of determining the filter range of the Q filter. This is an example of a case where a single type of the precursor ion is selected.

First, a width of an ion transmission region in the Q filter is defined as D while a set increment width of the ion transmission region is defined as $\Delta M$, and a maximum integer N satisfying $N \leq D/(2\Delta M)$ is calculated (S11). Next, mass spectrometry data MS1 are obtained (S12) and m/z=M of the precursor ion is determined (S13). Next, the center of the filter range in the Q filter is changed by the increment width $\Delta M$, and a total ion current (T) in the corresponding range is calculated (S14 to S16). This increment width $\Delta M$ is preferably set based on a peak width in the mass spectrometry spectrum because an excessively small increment width would just increase the amount of calculation. Practically, it is sufficient to set the value in a range from about 0.1 to 0.5 Da.

Next, an operating condition of the Q filter for i that brings about the lowest total ion current T(i) is determined (S17). In this process, the center of the filter range is determined so as to correspond to i that brings about the lowest total ion current T(i). Here, it is preferable to select i having a small absolute value when the same lowest value is found in more than one position because the ion transmission efficiency is assumed to become the maximum at a central portion in the filter range as shown in FIG. 21. Practically, it is possible to determine the center of the filter range so as to correspond to i having the T(i) value which is higher by about 30% than the lowest value of the total ion current T(i). Depending on the final isolation width, there may be a case where it is desirable to locate the precursor ion at the central part of the filter range particularly when the precursor ion includes an isotope peak. An effect of the present invention is valid as long as the value T(i) is set to a low value as compared to the case where the center of the filter range in the Q filter coincides with the precursor ions.

Next, an ion trap operating condition such as the accumulation time is determined based on the total ion current T(i) that becomes the lowest (S18). The accumulation time can be found by obtaining a ratio of T(i) corresponding to the filter range relative to an upper limit of an ion amount to be introduced to the ion trap, and then calculating a product of the ratio and the accumulation time for obtaining data of the mass spectrometry spectrum, for example. Subsequently, the tandem MS data is obtained by controlling the power sources for the Q filter and the ion trap in accordance with the determined operating conditions (S19).

The tandem mass spectrometry often employs a data dependent analysis in which only a predetermined number of precursor ions are prioritized for selection in descending order of ion intensity and then are analyzed. Naturally, if ions not needing the tandem mass spectrometry are known, the tandem mass spectrometry can also be set not to select those ions as the precursor ions. On the other hand, if ions, if detected, desired to be preferentially subjected to the tandem mass spectrometry are known, the tandem mass spectrometry can also be set to preferentially select those ions as the precursor ions. In this way, it is convenient to set the priorities for selecting the precursor ions before starting the analysis.

Figure 8:
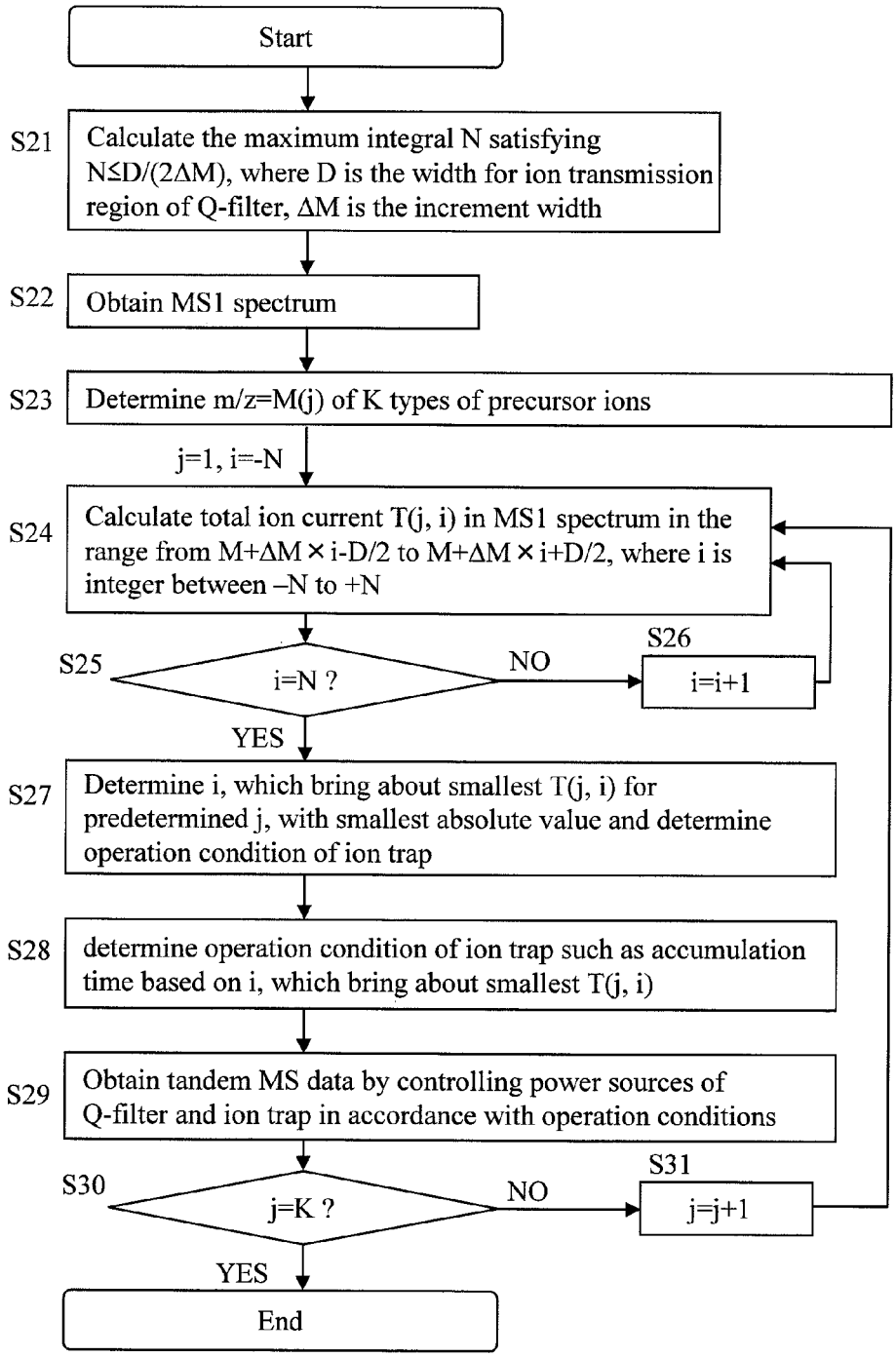
FIG. 8 is a flowchart showing an example of a method of determining the filter range of the Q filter.

An example of a method of determining the filter range in the Q filter in such a case is shown in a flowchart in FIG. 8. Step 21 to step 29 correspond to step 11 to step 19 in FIG. 7. However, multiple types of the precursor ions are determined in step 23. Moreover, since there are the multiple types of the precursor ions, the processes from step S24 to step 29 are repeated as much as the number of the types of the precursor ions (S30 and S31). Specifically, the mass spectrometry data (the mass spectrum) are obtained first (S22) and the priorities are given to peaks to be selected as the precursor ions among detected peaks (S23). The number K of these candidates for the precursor ions can be predetermined. When the tandem mass spectrometry is performed on K types of the precursor ions, the series of the tandem mass spectrometry is completed and the mass spectrum is obtained.

Although one session of the data is obtained for each type of the precursor ions in the examples shown in FIGS. 7 and 8, these examples may include a process for carrying out multiple sessions of obtaining data for each type of the precursor ions.

Second Embodiment

Figure 9:
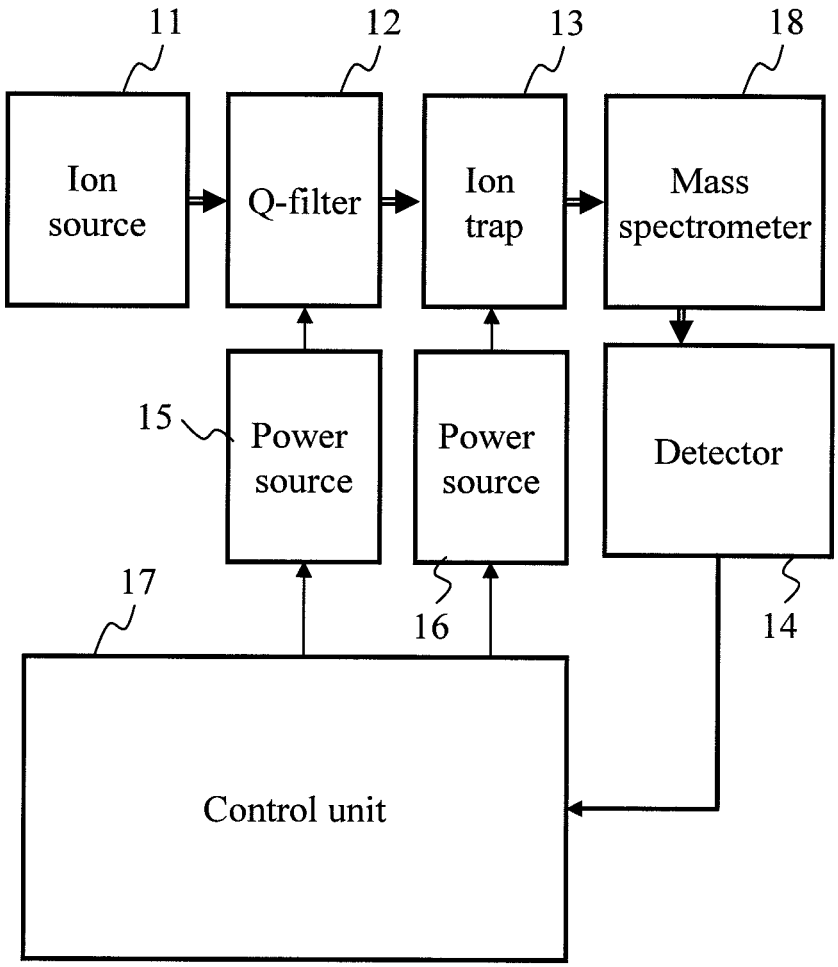
FIG. 9 is a block diagram of another embodiment of the device according to the present invention.
Figure 10:
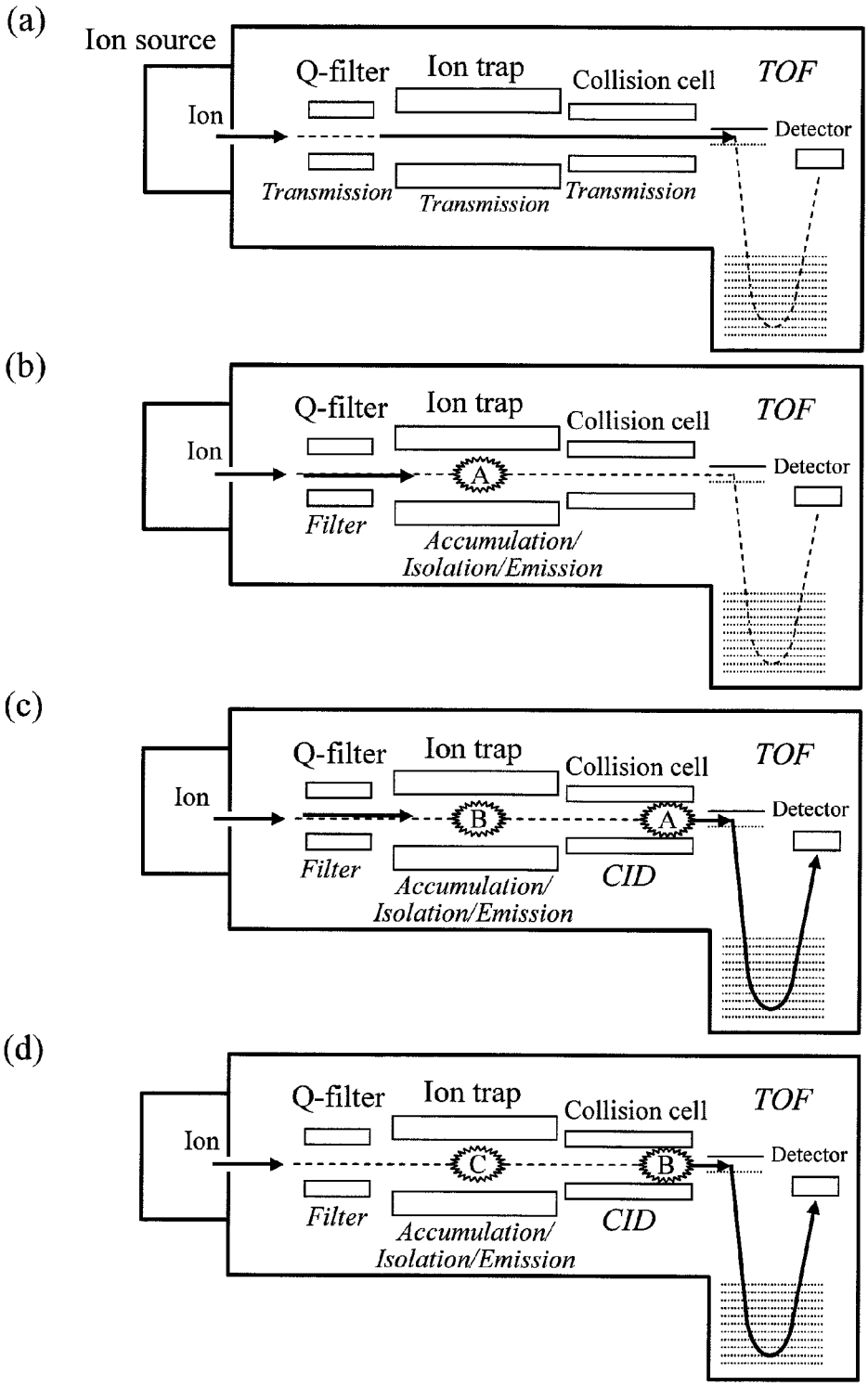
FIG. 10 is a schematic diagram showing movement of ions in another embodiment of the device according to the present invention.

FIG. 9 is a block diagram of another embodiment of the mass spectrometric device according to the present invention. FIG. 10 in which no power sources and control unit are illustrated is a schematic diagram showing movement of ions in the device. This embodiment represents an example of a hybrid-type mass spectrometer in which a mass spectrometer 18 such as a time-of-flight mass spectrometer is connected to a downstream side of the quadrupole ion trap 13. In this example, the time-of-flight mass spectrometer is used as the mass spectrometer 18. However, a similar effect is obtained by using other mass spectrometers such as a Fourier transform mass spectrometer or a magnetic sector (double focusing) mass spectrometer as the mass spectrometer 18.

Ions generated by the ion source 11 transmit through the Q filter 12 installed inside the vacuum device to be introduced to the quadrupole ion trap 13. In obtaining mass spectrometry data shown in FIG. 10(*a*), the power sources 15 and 16 for the Q filter power 12 and the quadrupole ion trap 13 are controlled by the control unit 17 and the majority of the ions are transmitted through the Q filter 12 and the quadrupole ion trap 13 almost independent of the m/z. Then, these ions are subjected to mass spectrometry by the time-of-flight mass spectrometer 18 and the accumulative mean of detector outputs for a certain period of time is calculated to obtain the mass spectrometry data (the mass spectrum). Here, for obtaining the mass spectrometry data, it is also possible to carry out the accumulation using the quadrupole ion trap 13 as described previously. In this case, the power source 16 for the quadrupole ion trap 13 is controlled by the control unit 17 so that the ions can be accumulated in the quadrupole ion trap. In order to avoid occurrence of the space charge effect in the quadrupole ion trap 13, the quadrupole ion trap power source 16 is controlled by the control unit 17 and the ion accumulation is executed only for a short time. After the accumulation is completed, the ions are transferred to the time-of-flight mass spectrometer 18 and are subjected to the mass spectrometry as described previously.

Next, in obtaining tandem mass spectrometry data shown in FIG. 10(*b*) to FIG. 10(*d*), the precursor ion subjected to the tandem mass spectrometry is selected by the control unit 17 based on the obtained mass spectrum and the center of the filter range in the Q filter 12 are determined so as to maximize the accumulation time for the precursor ions. Then, the Q filter 12 and the quadrupole ion trap 13 are controlled by the control unit 17 and the accumulation is executed in preparation for the tandem mass spectrometry.

As a result, the m/z of the first precursor ion does not always coincide with the center of the filter range but the group of ions (A) including this precursor ion transmits through the Q filter to accumulate in the quadrupole ion trap. After completing the accumulation, isolation for eliminating the ions other than the precursor ion in the quadrupole ion trap is carried out by applying the radio-frequency electric field. Then, the precursor ion thus isolated is introduced to a collision cell installed on the downstream side and are dissociated by the CID and the fragment ions are transferred to the time-of-flight mass spectrometer. The tandem mass spectrometry spectrum is obtained by carrying out the mass spectrometry.

Here, generation of the fragment ions by the CID can also be carried out in the quadrupole ion trap. In this case, the movement of the precursor ion is excited by using a radio-frequency electric field so as to carry out the dissociation of the precursor ion by way of collisions with the residue gas. The fragment ions thus generated are transferred to the time-of-flight mass spectrometer and the tandem mass spectrometry spectrum is obtained by carrying out the mass spectrometry. When the CID is carried out in the quadrupole ion trap, an extra time is required as compared to the case of carrying out the CID in the collision cell. However, the type of the fragment ions is slightly different here. For this reason, it is desirable to select whether to carry out the CID in the collision cell or the quadrupole ion trap depending on the purpose of the analysis.

When multiple sessions of the tandem mass spectrometry are continuously carried out, a group of ions (B) containing the second precursor ion and the like transmits through the Q filter as soon as the ions are emitted from the quadrupole ion trap to the downstream side as shown in FIG. 10(*c*), and then accumulates in the quadrupole ion trap. At this time, the center of the filter range in the Q filter and the accumulation time in this case have been predetermined by the control unit and the tandem mass spectrometry is carried out as in the case of the group of ions (A). As shown in FIG. 10(*d*), accumulation for the third precursor ion is also performed in a similar manner.

Third Embodiment

Figure 11:
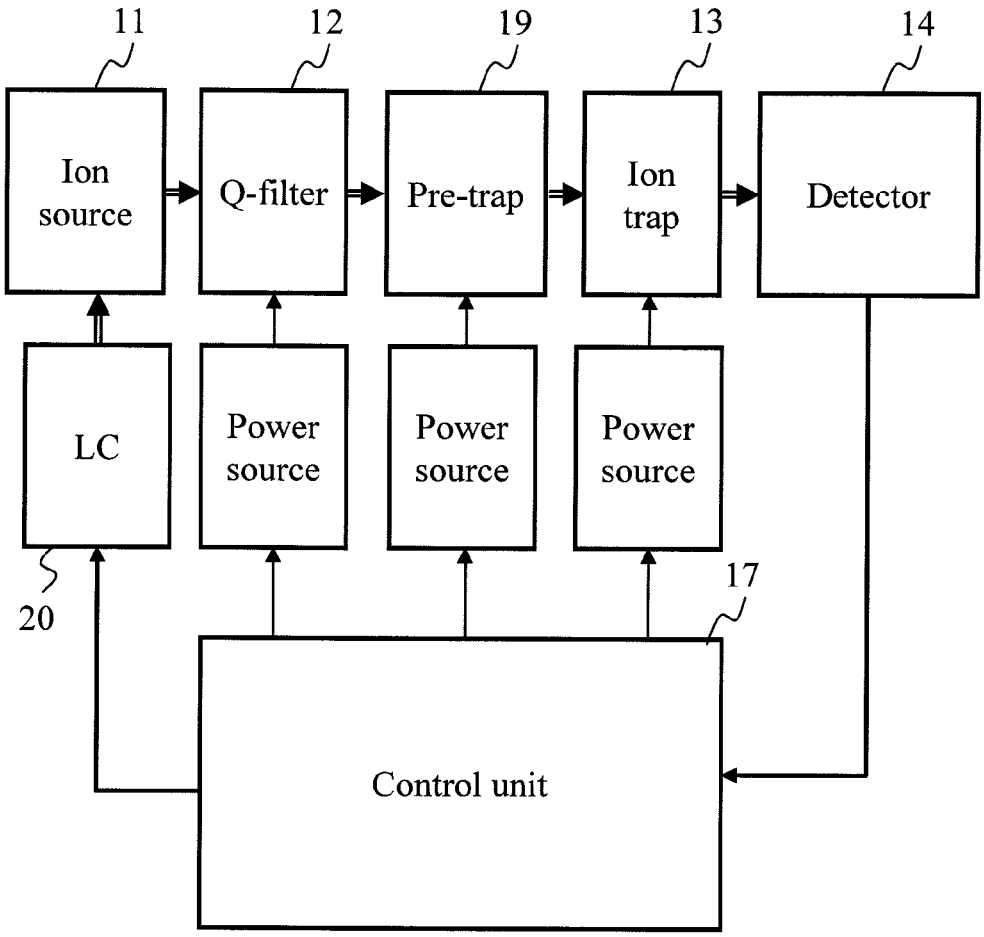
FIG. 11 is a block diagram of still another embodiment of the device according to the present invention.
Figure 12:
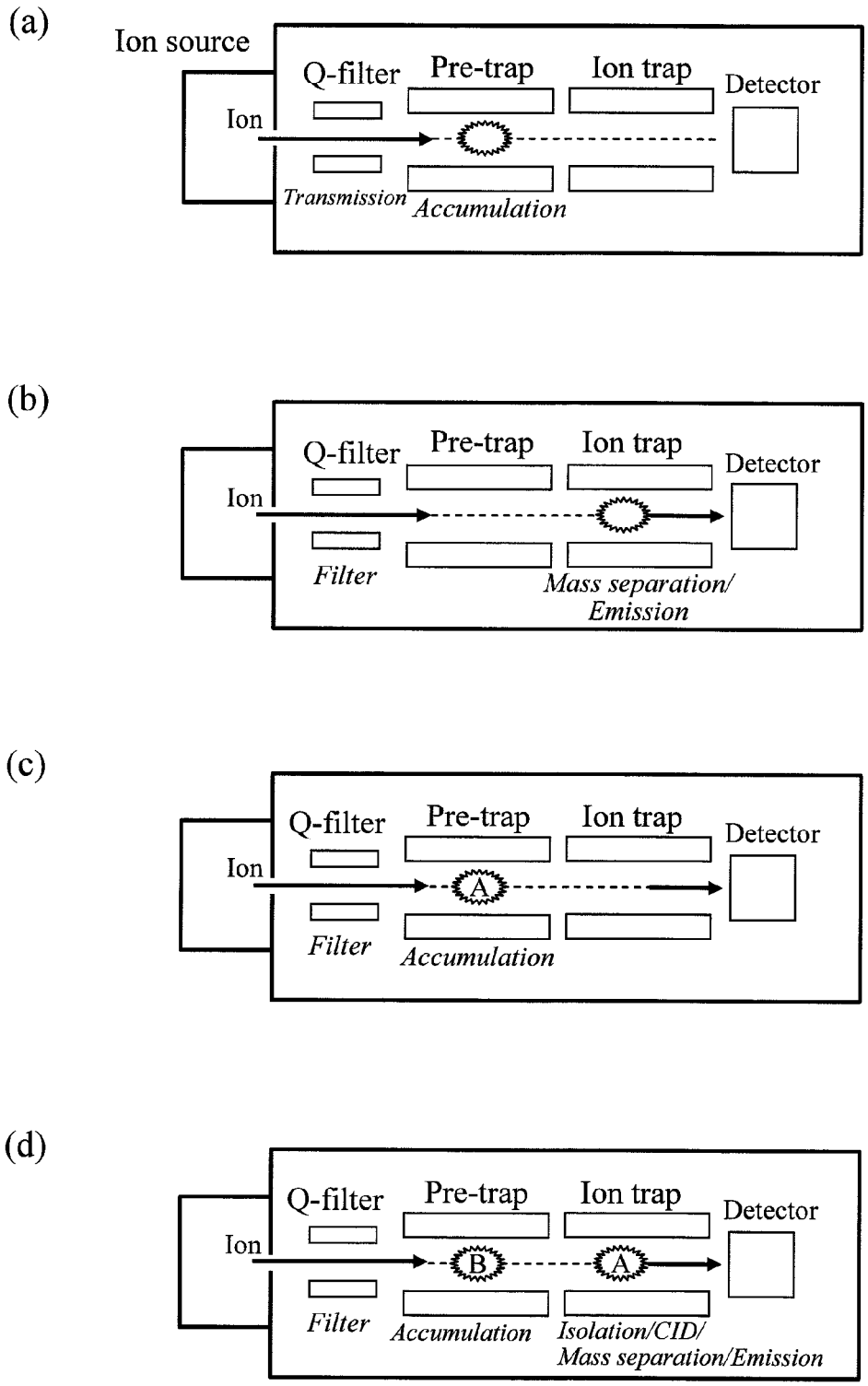
FIG. 12 is a schematic diagram of motions of ions in still another embodiment of the device according to the present invention.

FIG. 11 is a block diagram of still another embodiment of the mass spectrometric device according to the present invention. FIG. 12 in which no power sources and control unit are illustrated is a schematic diagram showing movement of ions in the device. This embodiment is close to the embodiment shown in FIG. 1 but shows an example of the mass spectrometric device provided with a pre-trap 19 between the Q filter 12 and the quadrupole ion trap 13. Although it is ideal to provide the pre-trap 19 which is the same as the quadrupole ion trap 13, the pre-trap 19 may be a multi-pole ion trap having a different size or a different number of pole electrodes as long as such an ion trap can accumulate the same amount of ions as the quadrupole ion trap without causing the space charge effect. A sample eluted from a liquid chromatograph 20 is introduced to the ion source 11.

As shown in FIG. 12(*a*), ions generated by the ion source 11 transmit through the Q filter 12 installed inside the vacuum device to be introduced to the pre-trap 19. After the ions have accumulate in the pre-trap 19 for a time period which is preset so as not to cause the space charge effect, the group of ions is transferred to the quadrupole ion trap 13. Then, for obtaining the mass spectrometry data shown in FIG. 12(*b*), the power sources operate the quadrupole ion trap so as to emit the ions based on the m/z. The mass spectrum is obtained by detecting the emitted ions with the detector.

Next, for obtaining tandem mass spectrometry data, the precursor ion subjected to the tandem mass spectrometry is selected by the control unit based on the obtained mass spectrum and the center of the filter range in the Q filter relative to the precursor ions as well as the accumulation time in the pre-trap are determined. Then, as shown in FIG. 12(*c*), accumulation of the first precursor ion in preparation for the tandem mass spectrometry is executed by the pre-trap. When the accumulation is completed, the group of ions (A) including the first precursor ion is transferred to the quadrupole ion trap. Then, as shown in FIG. 12(*d*), the pre-trap starts accumulation of the group of ions (B) including the second precursor ion. In the meantime, isolation for eliminating the ions other than the precursor ion in the group of ions (A) with the quadrupole ion trap is carried out by applying the radio-frequency electric field. The movement of the precursor ion is excited by using another radio-frequency electric field so as to implement the dissociation (the CID) of the precursor ions by way of collisions with the residue gas. The power source is operated so as to emit the dissociated ions to the detector based on the m/z. The tandem mass spectrometry spectrum is obtained by sequentially detecting the emitted ions with the detector.

According to the mass spectrometric device configured as described above, it is possible to make effective use of the ions continuously introduced to the vacuum device when continuously performing the tandem mass spectrometry on the multiple types of the precursor ions. Hence the analysis throughput tends to be enhanced. In particular, the mass spectrometer is effective when the time required for the mass spectrometry with the quadrupole ion trap is equal to or below the accumulation time.

Fourth Embodiment

Figure 13:
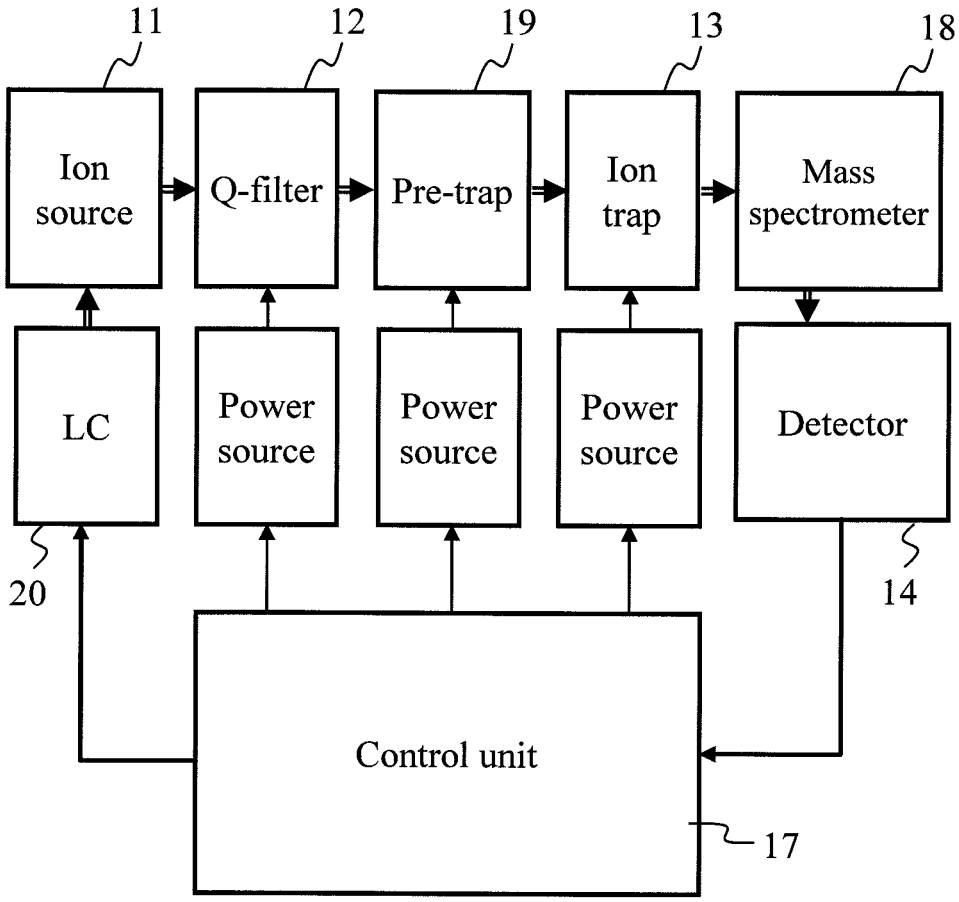
FIG. 13 is a block diagram of yet still another embodiment of the device according to the present invention.
Figure 14:
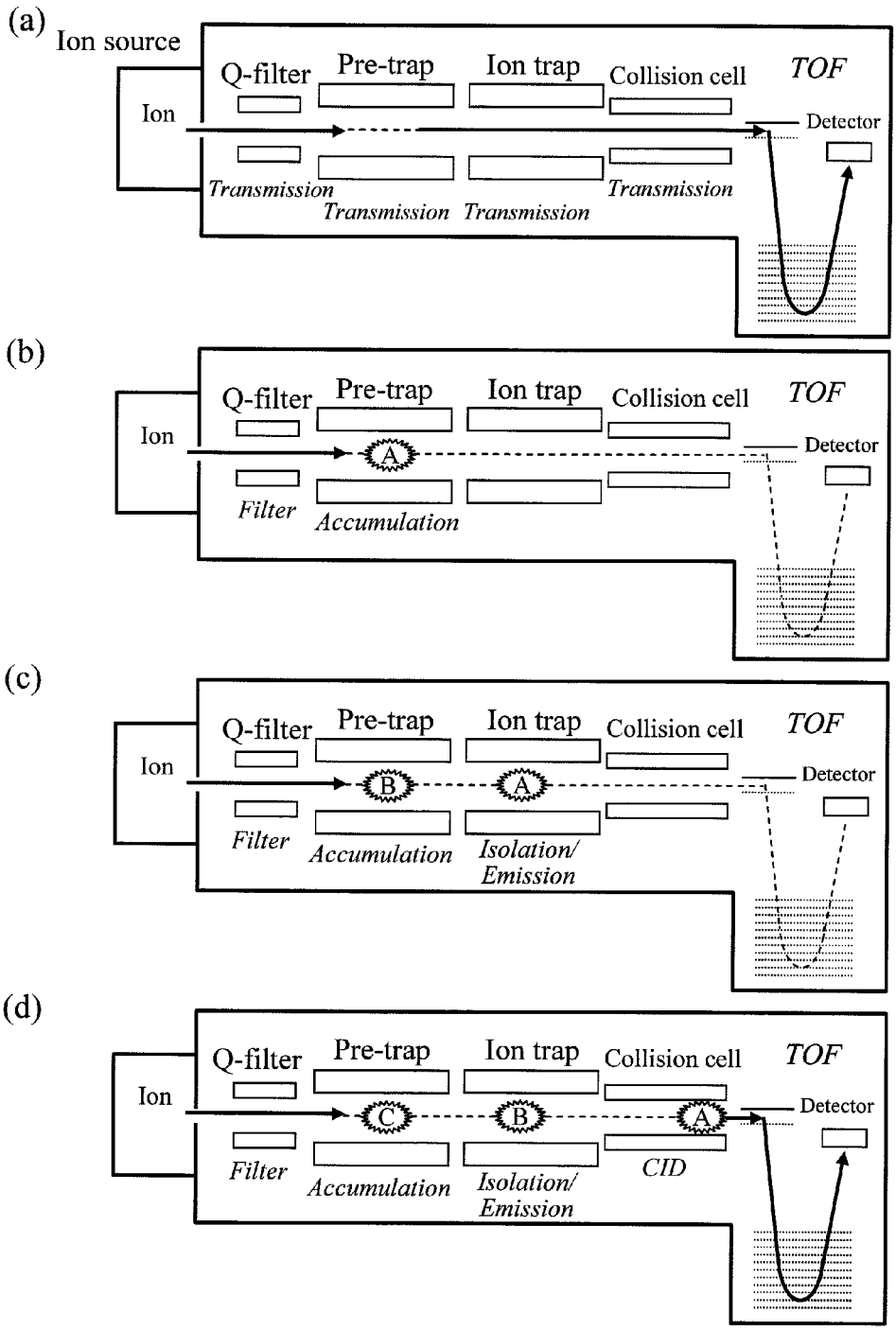
FIG. 14 is a schematic diagram of motions of ions in yet still another embodiment of the device according to the present invention.

FIG. 13 is a block diagram of yet still another embodiment of the mass spectrometric device according to the present invention. FIG. 14 in which no power sources and control unit are illustrated is a schematic diagram showing movement of ions in the device. This embodiment is close to the embodiment shown in FIG. 9 but shows an example of the mass spectrometric device provided with the pre-trap 19 between the Q filter 12 and the quadrupole ion trap 13 and with the mass spectrometer 18 such as the time-of-flight mass spectrometer connected to the downstream side of the quadrupole ion trap 13. A sample eluted from a liquid chromatograph 20 is introduced to the ion source 11.

Ions generated by the ion source 11 transmit through the Q filter 12 installed inside the vacuum device and the pre-trap 19 to be introduced to quadrupole ion trap 13. For obtaining the mass spectrometry data shown in FIG. 14(*a*), the power sources for the Q filter, the pre-trap, and the quadrupole ion trap are controlled by the control unit so that the majority of the ions can be transmitted through the Q filter, the pre-trap, and the quadrupole ion trap almost independent of the m/z. Then, these ions are subjected to the mass spectrometry with the time-of-flight mass spectrometer (TOF) and accumulative mean of the detector outputs for a certain period of time is taken to obtain the mass spectrometry data (the mass spectrum). Here, for obtaining the mass spectrometry data, it is also possible to carry out the accumulation using the pre-trap or the quadrupole ion trap. In this case, the power source for the pre-trap or the quadrupole ion trap is controlled by the control unit so that the ions can accumulate in the pre-trap or the quadrupole ion trap. For the pre-trap or the quadrupole ion trap, the power source is controlled by the control unit in order to avoid occurrence of the space charge effect and the ion accumulates only for a short time. After the accumulation is completed, the ions are transferred to the time-of-flight mass spectrometer and are subjected to the mass spectrometry as described previously.

Next, in obtaining tandem mass spectrometry data, the precursor ions subjected to the tandem mass spectrometry are selected by the control unit based on the obtained mass spectrum and the center of the filter range in the Q filter as well as the accumulation time using the pre-trap are determined. Then, as shown in FIG. 14(*b*), accumulation for the first precursor ion in preparation for the tandem mass spectrometry is executed by the pre-trap. When the accumulation of the group of ions (A) including the first precursor ion is completed, the group of ions (A) is transferred to the quadrupole ion trap. Then, as shown in FIG. 14(*c*), the pre-trap starts accumulation of the group of ions (B) including the second precursor ion. In the meantime, isolation for eliminating the ions other than the precursor ion in the group of ions (A) with the quadrupole ion trap is carried out by applying the radio-frequency electric field. Moreover, the precursor ion thus isolated is introduced to the collision cell installed on the downstream side to be dissociated by the CID. The generated fragment ions are transferred to the time-of-flight mass spectrometer. The tandem mass spectrometry spectrum is obtained by carrying out the mass spectrometry.

Here, generation of the fragment ions by the CID can also be implemented in the quadrupole ion trap. In this case, the movement of the precursor ion is excited by using a radio-frequency electric field so as to implement the dissociation of the precursor ions by way of collisions with the residue gas. The fragment ions thus generated are transferred to the time-of-flight mass spectrometer and the tandem mass spectrometry spectrum is obtained by carrying out the mass spectrometry. When the CID is carried out in the quadrupole ion trap, an extra time is required as compared to the case of carrying out the CID in the collision cell. However, the type of the fragment ions is slightly different here. For this reason, it is desirable to select whether it is appropriate to carry out the CID in the collision cell or the quadrupole ion trap depending on the purpose of the analysis.

When multiple sessions of the tandem mass spectrometry are continuously carried out, the group of ions (B) containing the second precursor ion and the like transmits through the Q filter as soon as the ions are emitted from the quadrupole ion trap to the downstream side as shown in FIG. 14(*c*), and then accumulates in the quadrupole ion trap. At this time, the center of the filter range in the Q filter and the accumulation time in this case have been predetermined by the control unit and the tandem mass spectrometry is carried out as in the case of the group of ions (A). Further, as shown in FIG. 14(*d*), accumulation for the third precursor ion is also performed in a similar manner According to the mass spectrometric device having the configuration shown in FIG. 13 and FIG. 14, it is possible to make effective use of the ions continuously introduced to the vacuum device when continuously performing the tandem mass spectrometry on multiple precursor ions. Hence the analysis throughput tends to be enhanced. In particular, the time required for the mass spectrometry in the time-of-flight mass spectrometer is sufficiently shorter than the accumulation time and thus it is advantageous.

Alternatively, it is also possible to use an ion-cyclotron resonance (ICR) mass spectrometer or a Fourier transform mass spectrometer (FTMS) such as an orbitrap mass spectrometer as the mass spectrometer instead of the time-of-flight mass spectrometer. Here, the time required for the mass spectrometry may be set longer than the accumulation time. In this case, it is efficient to obtain the mass spectrometry data by using the mass spectrometer such as the Fourier transform mass spectrometer that requires a long analysis time and to obtain different data simultaneously by using the quadrupole ion trap.

Figure 15:
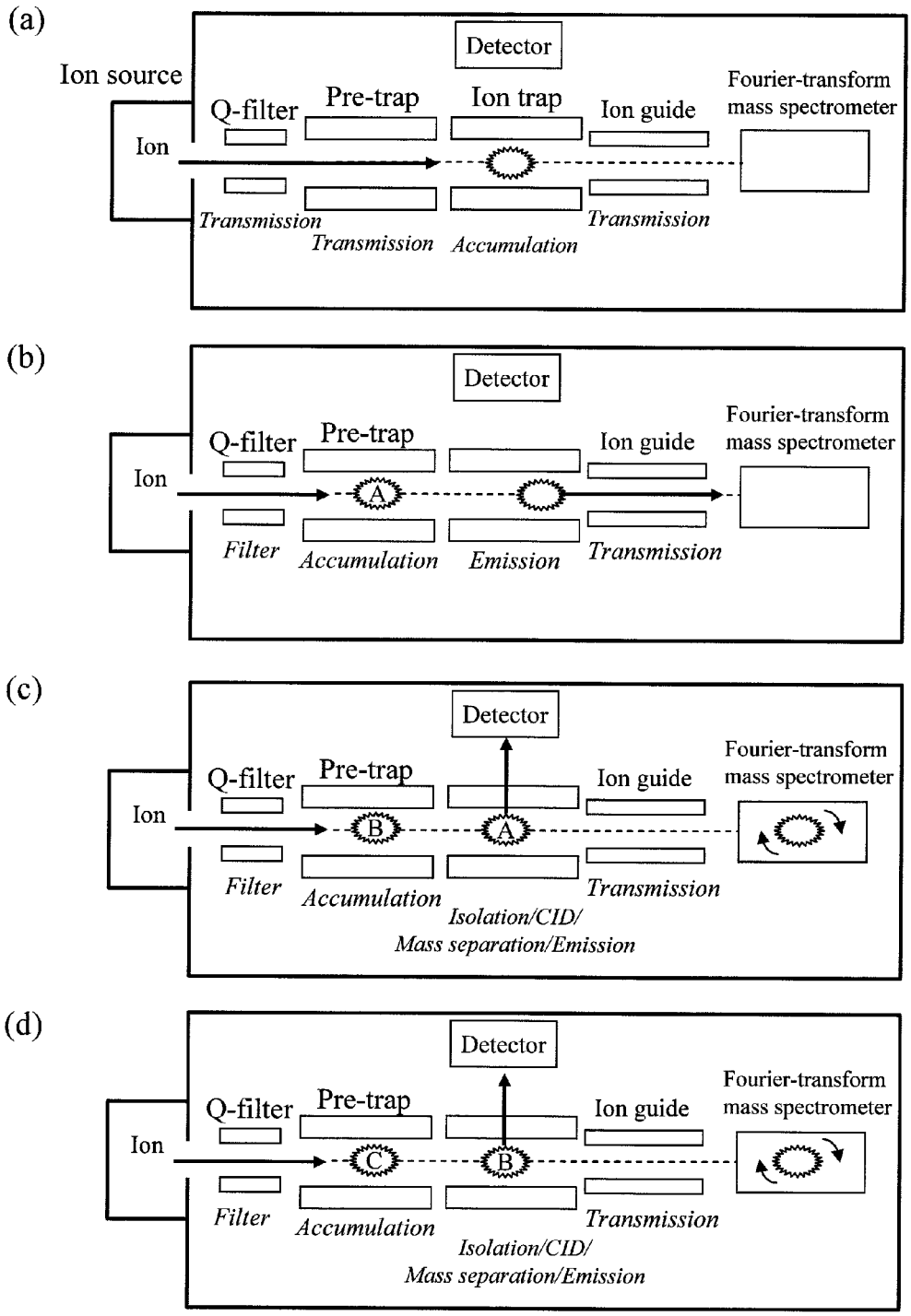
FIG. 15 is a block diagram of yet still another embodiment of the device according to the present invention.

In an example shown in FIG. 15, the detector is installed in the vicinity of the quadrupole ion trap so that it is possible to use the quadrupole ion trap also as the mass spectrometer and to emit mass-separated ions toward the detector. Specifically, the ions transmitted through the Q filter accumulate in the pre-trap as shown in FIG. 15(*a*). The ions may accumulate in the pre-trap. For the pre-trap or the quadrupole ion trap, the power source is controlled by the control unit (not shown) so as to avoid occurrence of the space charge effect and the ion accumulation is executed only for a short time. After the accumulation is completed, the ions transmit through an ion guide to be introduced to the Fourier transform mass spectrometer in which the mass spectrometry is carried out. While carrying out this mass spectrometry, the accumulation is executed by the pre-trap in preparation for the tandem mass spectrometry for the first precursor ion. In this accumulation, the precursor ions subject to the tandem mass spectrometry are selected by the control unit based on the mass spectrometry data which are obtained in advance. Meanwhile, the center of the filter range in the Q filter and the accumulation time using the pre-trap are determined.

Thereafter, as shown in FIG. 15(*c*), when the accumulation is completed, the group of ions (A) is transferred to the quadrupole ion trap and the precursor ion is isolated and subjected to the dissociation by the CID and the like. Then, the generated fragment ions are mass-separated and are sequentially detected with the detector located in the vicinity of the quadrupole ion trap. In this way, the tandem mass spectrometry for the first precursor ion is carried out. At this time, the group of ions (B) containing the second precursor ion accumulates in the pre-trap. It is possible to obtain the data efficiently by controlling the mass spectrometric device as described above. Then, as the tandem mass spectrometry for the second precursor ions is started as shown in FIG. 15(*d*), a group of ions (C) containing the third precursor ion accumulates in the pre-trap.

In this example, the mass spectrometry data are obtained by using the Fourier transform mass spectrometer while the tandem mass spectrometry data are obtained by using the quadrupole ion trap. However, it is also possible to obtain the tandem mass spectrometry data by using the Fourier transform mass spectrometer depending on the purpose of the analysis.

Figure 16:
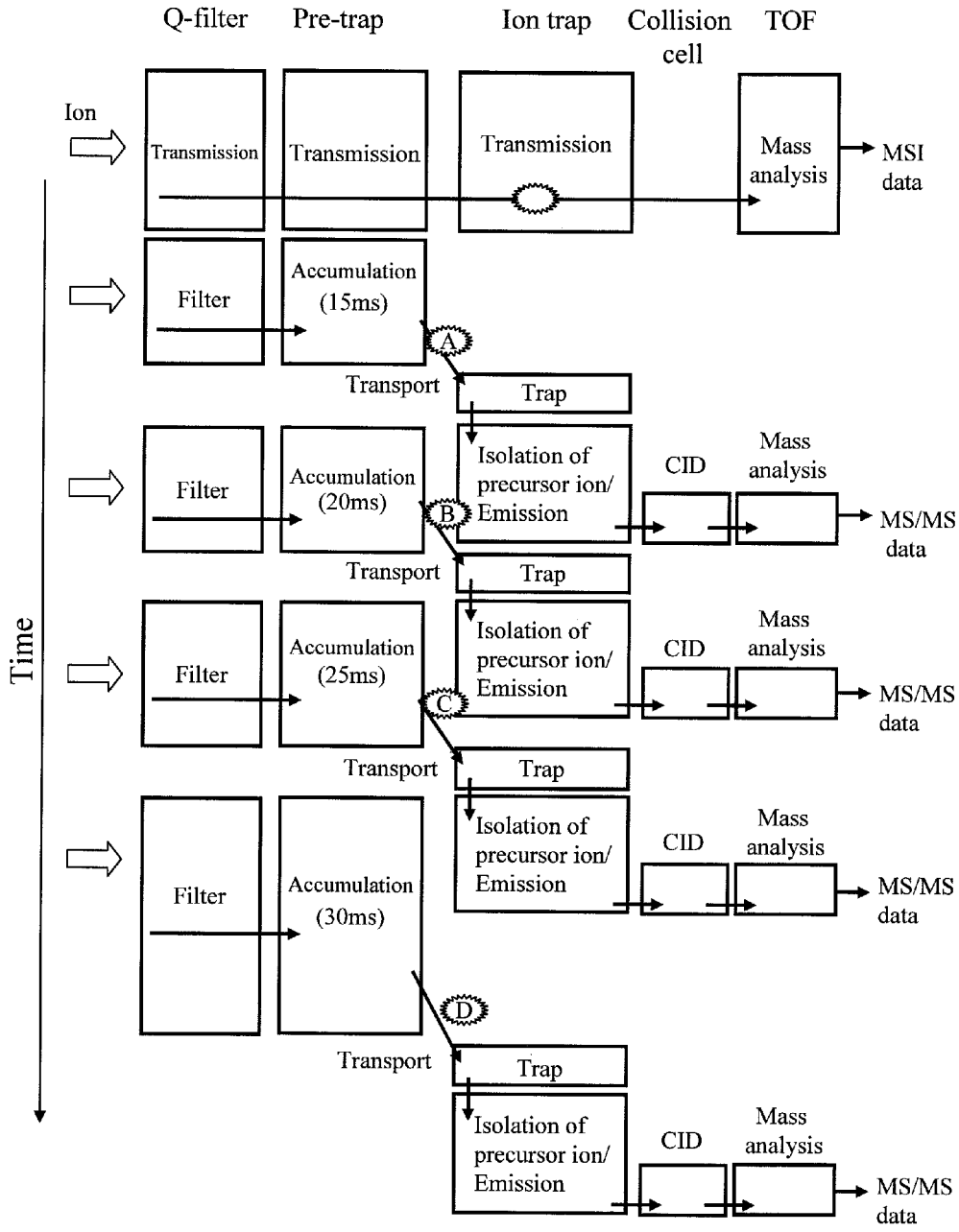
FIG. 16 is a view showing an operation sequence of respective constituents in yet still another embodiment of the device according to the present invention.

FIG. 16 schematically shows an operation sequence of the Q filter, the pre-trap, the quadrupole ion trap, the collision cell, and the time-of-flight mass spectrometer in the mass spectrometric device having the configuration shown in FIG. 13 and FIG. 14. FIG. 16 shows the operation sequence, from the upper side to the lower side, in chronological order and shows that the accumulation time in the pre-trap is changed depending on the precursor ions. Moreover, each device is operated at high operation rate and the effective use of the ions by installing the pre-trap is shown. In this example, the isolation is performed on the single type of the precursor ion by using the ion trap.

Figure 17:
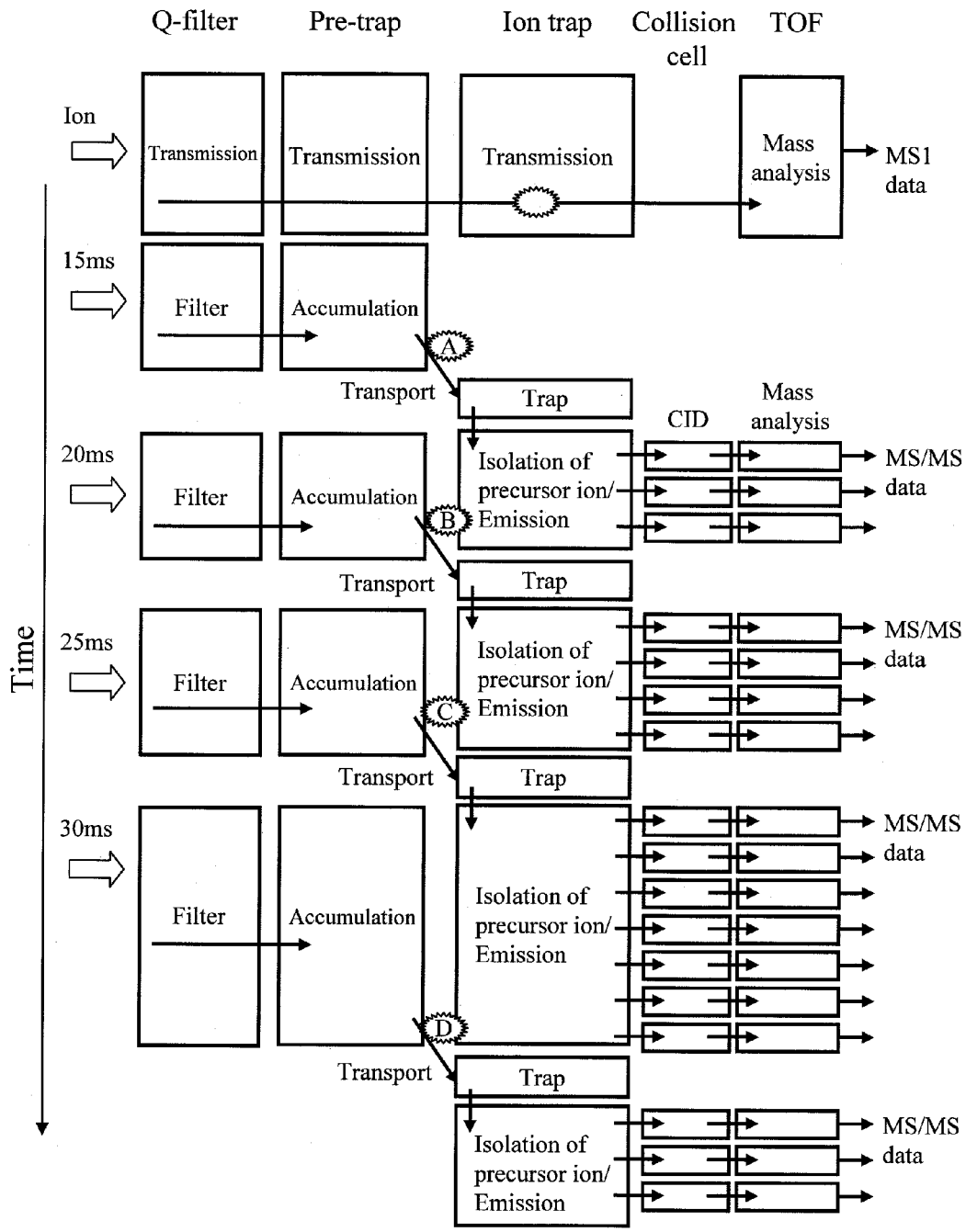
FIG. 17 is a view showing an operation sequence of respective constituents in yet still another embodiment of the device according to the present invention.

In the tandem mass spectrometry using the quadrupole ion trap, the isolation of the single type of the precursor ion is often carried out for one session of the accumulation as described above. However, by utilizing a fringing field generated on an ion exit side of the quadrupole ion trap, it is possible to emit only the ions having a specific m/z to the downstream side on the order of milliseconds. By utilizing this characteristic feature, it is possible to perform the tandem mass spectrometry sequentially on multiple types of the precursor ions that transmit through the Q filter and accumulate in the quadrupole ion trap as shown in FIG. 17. Specifically, it is possible to enhance the analysis throughput of the tandem mass spectrometry by several times by sequentially emitting the multiple types of the precursor ions trapped by the quadrupole ion trap and introducing the respective types of the precursor ions to the collision cells and the time-of-flight mass spectrometers. Nevertheless, it is desirable to perform emission of the precursor ions sequentially at a time interval on the order of milliseconds so as not to cause crosstalk among the precursor ions. Naturally, a method of sweeping (scanning) the m/z of the emitted ions in a mass range with the precursor ion as the center may be employed instead of the method of emitting only the ions having the specific m/z. Moreover, it is also possible to employ a method of sweeping the m/z of the emitted ions in the entire filter range in the Q filter and thereby sequentially emitting the detected ions.

Figure 18:
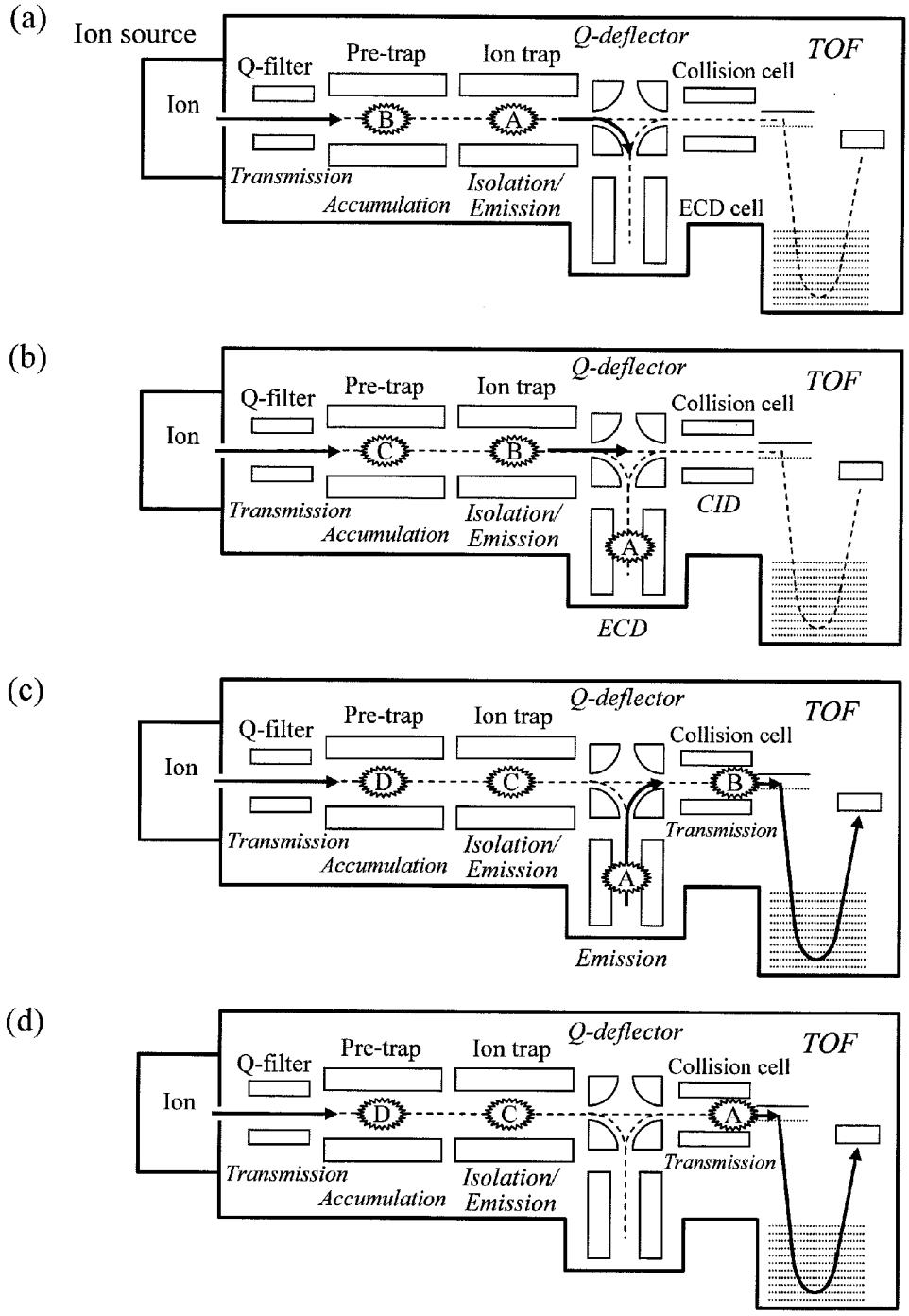
FIG. 18 is a schematic diagram of motions of ions in yet still another embodiment of the device according to the present invention.

Meanwhile, the tandem mass spectrometry can utilize ion dissociation techniques such as electron capture dissociation (ECD) or electron transfer dissociation (ETD) besides the CID. According to these methods, it is possible to obtain complementary tandem mass spectrometry information for the CID case. Hence these methods may be utilized in combination with the CID. However, the CID using the collision cell only requires the time below milliseconds for the ion dissociation whereas the ECD or the ETD may occasionally require a longer time in a range from ten to several tens of milliseconds. Therefore, in the mass spectrometric device as shown in FIG. 18, it is possible to perform the CID by using the collision cell and to perform the ECD or the ETD in a different quadrupole ion trap (an ECD cell or an ETD cell). For this reason, the center of the filter range in the Q filter and the accumulation time using the pre-trap are determined based on the mass spectrum obtained in advance in the accumulation of the precursor ions using the quadrupole ion trap.

FIG. 18 shows the tandem mass spectrometry. The group of ions (A) firstly accumulated in the process shown in FIG. 18(*a*) is introduced to the ECD cell by a Q-deflector, and is subjected to the ECD as shown in FIG. 18(*b*). Meanwhile, the group of ions (B) secondly accumulated is isolated by the quadrupole ion trap and is introduced to the collision cell via the Q-deflector. Then, as shown in FIG. 18(*c*), the dissociation by the CID takes place and the dissociated ions thus generated are subjected to the mass spectrometry with the mass spectrometer. When the dissociation of the group of ions (B) is completed, the group of ions (A) after the ECD transmits through the collision cell to be subjected to the mass spectrometry with the mass spectrometer. At the same time, the group of ions (C) thirdly accumulated is isolated in the quadrupole ion trap. By carrying out the analysis in accordance with the above-described sequence, it is possible to obtain the tandem mass spectrometry data efficiently by way of the ECD and the CID. The accumulation of the ions by using the pre-trap is similar to the example shown in FIG. 14.

As shown in FIG. 17, selection of the precursor ions is slightly complicated when using a quadrupole ion trap capable of emitting only the ions having the specific m/z for about milliseconds. Accordingly, a method of determining the filter range in the Q filter will be described with reference to mass spectra shown in FIGS. 19(*a*) and 19(*b*).

Figure 19:
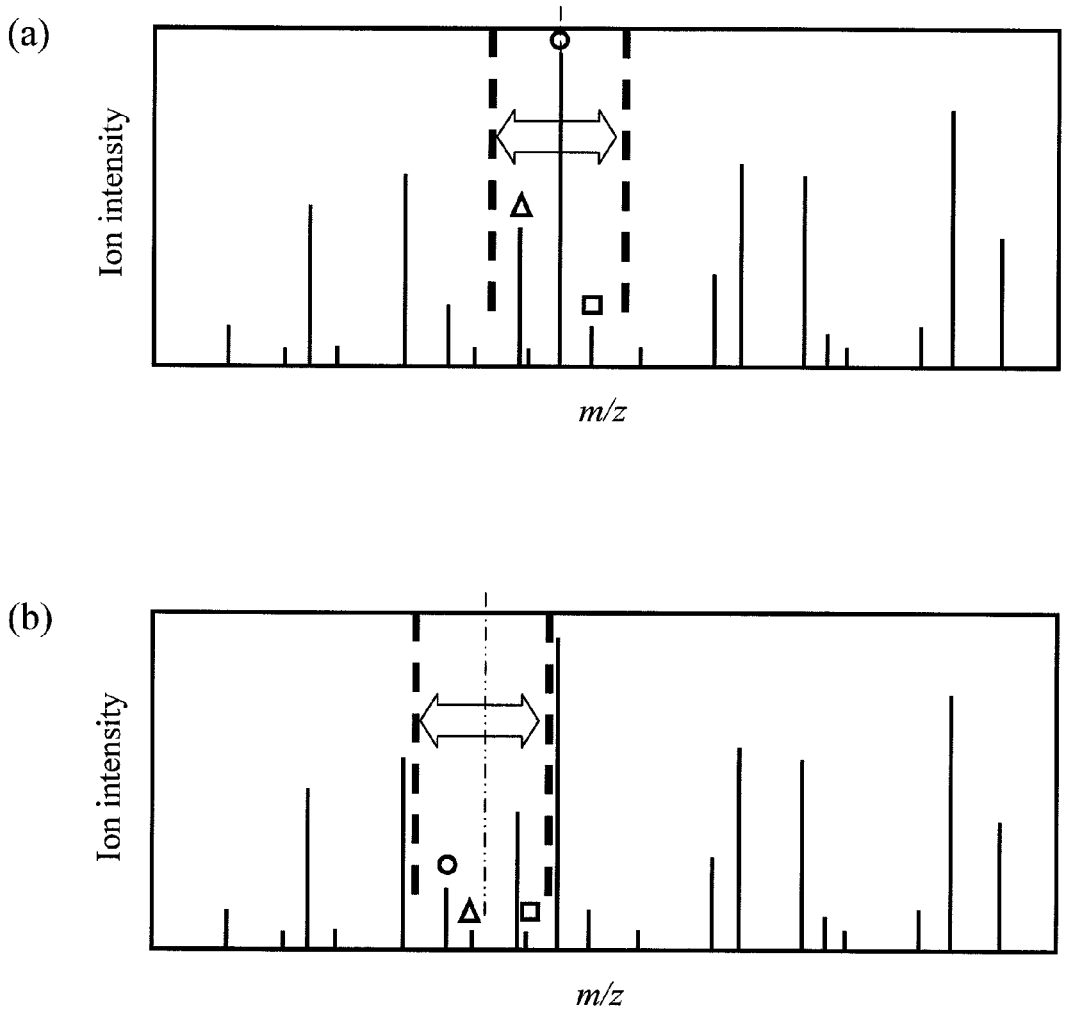
FIG. 19 is a diagram showing filter ranges of a Q filter in mass spectra in still another embodiment of the device according to the present invention.

As shown in FIGS. 19(*a*) and 19(*b*), multiple ions may often be included in the filter range in the Q filter when numerous ions are detected. The selected precursor ions are indicated with ○Δ□ and the like according to the priorities while the filter ranges in the Q filter are indicated with dotted lines and arrows. The accumulation time in the quadrupole ion trap is determined based on the total ion current in the filter range. For this reason, it is expected that the tandem mass spectrometry data are obtained at a high S/N ratio by selecting the ion having the highest intensity among the ions included in the filter range as the precursor ion. However, if an ion having intensity one tenth or smaller than the highest intensity of the ion is selected among the ions included in the filter range, it is expected that the tandem mass spectrometry data are obtained at a relatively low S/N ratio. For this reason, it is one of guide lines to select only the precursor ion not larger in ion intensity than other ions for more than 10 times. For this reason, one of guide lines for precursor ion selection is to select only ions having ion intensities which vary within a range of one to ten times. For example, a weak peak is detected between the ions labeled with ○ and Δ in FIG. 19(*a*). Regarding this peak, the accumulation time becomes longer by performing the accumulation in the filter range as shown in FIG. 19(*b*). Hence it is possible to use more ions for the tandem mass spectrometry with the same accumulated count.

As described above, the tandem mass spectrometry data are obtained at a high S/N ratio for weak ions as well by automatically optimizing the filter range in the Q filter by using the control unit upon selection of the precursor ion. Specifically, when there is a region overlapping a Q filter region and the precursor ion is located in the overlapping region in the data dependent analysis in which multiple sessions of the accumulation are performed, it is desirable to perform the tandem mass spectrometry of the precursor ions by the accumulation with the longer accumulation time.

Fifth Embodiment

Along enhancement of analytical sensitivity of the mass spectrometric device, it is possible to detect minor components that have not been previously detected when analyzing a sample originating from a living organism in particular. This means detection of the ions having small intensity in the vicinity of the ions having super high intensity in the mass spectrum and it is becoming more important to perform the tandem mass spectrometry on these minor ions. However, as shown in FIG. 19(*a*), if the filter range in the Q filter is set to locate numerous ions between the ions labeled with ○ and Δ, it may be difficult to obtain the tandem mass spectrometry data at a sufficiently high S/N ratio in the tandem mass spectrometry of the minor ions located between the ions labeled with ○ and Δ, unless the accumulated count is increased specially. However, a drastic increase in the accumulated count leads to significant degradation of the analysis throughput.

Figure 20:
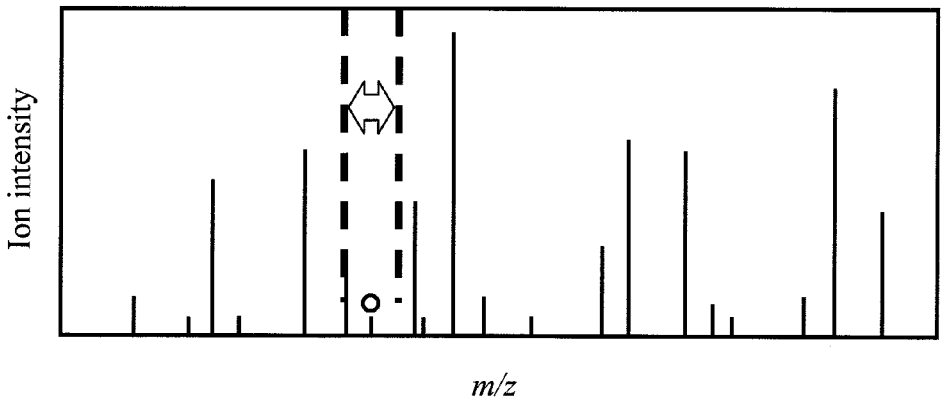
FIG. 20 is a diagram showing filter ranges of a Q filter in mass spectra in still another embodiment of the device according to the present invention.

Accordingly, it may be effective to automatically set a narrow filter range as shown in FIG. 20 only when selecting as the precursor ion an ion that coexists with an ion having high intensity in close m/z. When no ions having high intensity are included in the filter range, it is possible to set the sufficiently long accumulation time and thereby to obtain the tandem mass spectrometry data at a high S/N ratio. In this case, by measuring ion transmission efficiency as shown in FIG. 21 in advance and automatically correcting the ion transmission efficiency in terms of the ion intensity detected by using the detector, it is possible to perform a quantitative analysis of the obtained tandem mass spectrometry data as similar to other data. In an actual analysis, a wide filter range which can achieve substantially 100% of the ion transmission efficiency is first designated as described in the first embodiment. Here, it is desirable to set the narrower filter range automatically and to perform the tandem mass spectrometry only when selecting as the precursor ion the ion coexisting with the ions having the high intensity in the close m/z. Similar effect can be obtained even when the relatively narrow filter is designated first and there is no problem as long as the ion transmission efficiency is corrected.

As described above, when only ions having ion intensities which vary within a range of 1 to 10 times exist in the close m/z, the ion transmission rate of substantially 100% is achieved by setting the wide filter range. Meanwhile, for a minor ion coexisting with ions having ion intensity as large as or greater than 10 times of the minor ion, it is one of solutions to set the narrow filter range and to perform the tandem mass spectrometry. Therefore, in the case of the mass spectrometer having sufficiently high analysis throughput, it is desirable to automatically switch between a mode of normally setting the wide filter range in the Q filter as shown in FIG. 19(*b*) and a mode of exceptionally setting the narrow filter range as shown in FIG. 20 based on the mass spectrometry data. Moreover, for the data obtained by exceptionally setting the narrow filter range in the Q filter, it is desirable to attach information indicating the setting for the purpose of distinction in order to avoid the data from being quantitatively analyzed as similar to other data.

EXPLANATION OF THE REFERENCE NUMERALS

11 ION SOURCE
12 Q FILTER
13 ION TRAP
14 DETECTOR
17 CONTROL UNIT
18 MASS SPECTROMETER
19 PRE-TRAP
20 LIQUID CHROMATOGRAPH

The invention claimed is:

1. A sample analysis method using a mass spectrometric system including an ion source configured to ionize a sample, a quadrupole filter located at a subsequent stage of the ion source, an ion trap located at a subsequent stage of the quadrupole filter, an ion detector located at a subsequent stage of the ion trap, and a control unit configured to control the quadrupole filter and the ion trap, the method comprising the steps executed by the control unit of:

obtaining mass spectrometry data of the sample by setting the quadrupole filter to allow an ion to transmit therethrough;

selecting a precursor ion in tandem mass spectrometry based on the mass spectrometry data;

setting a filter range of the quadrupole filter to transmit the ion in a range of a predetermined mass to charge ratio, and setting the center of the filter range such that the precursor ion is included in the filter range and that a total ion current transmitted through the quadrupole filter is reduced as compared to a case where the center of the filter range coincides with the precursor ion;

determining accumulation time in the ion trap based on the filter range having the center set and on the mass spectrometry data; and performing tandem mass spectrometry on the precursor ion in accordance with the determined operating conditions of the quadrupole filter and the ion trap.

2. The sample analysis method according to claim 1, wherein the control unit sets the center of the filter range such that the total ion current transmitted through the quadrupole filter is minimized.

3. A sample analysis method using a mass spectrometric system including an ion source configured to ionize a sample, a quadrupole filter located at a subsequent stage of the ion source, an ion trap located at a subsequent stage of the quadrupole filter, an ion detector located at a subsequent stage of the ion trap, and a control unit configured to control the quadrupole filter and the ion trap, the method comprising the steps executed by the control unit of:

obtaining mass spectrometry data of the sample by setting the quadrupole filter to allow an ion to transmit therethrough;

selecting a precursor ion in tandem mass spectrometry based on the mass spectrometry data;

setting a filter range of the quadrupole filter to transmit the ion in a range of a predetermined mass to charge ratio and setting the center of the filter range such that the precursor ion is included in the filter range and accumulation time for the ion in the ion trap is longer than in a case where the center of the filter range coincides with the precursor ion;

determining accumulation time in the ion trap based on the filter range having the center set and on the mass spectrometry data; and performing tandem mass spectrometry on the precursor ion in accordance with determined operating conditions of the quadrupole filter and the ion trap.

4. The sample analysis method according to claim 3, wherein the control unit determines the center of the filter range such that the accumulation time is maximized.

* * * * *